US006965099B1

(12) United States Patent
Habeger, Jr. et al.

(10) Patent No.: US 6,965,099 B1
(45) Date of Patent: Nov. 15, 2005

(54) GEOMETRY FOR WEB MICROWAVE HEATING OR DRYING TO A DESIRED PROFILE IN A WAVEGUIDE

(75) Inventors: Charles C. Habeger, Jr., Smyrna, GA (US); Timothy F. Patterson, Atlanta, GA (US); Frederick W. Ahrens, Duluth, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 393 days.

(21) Appl. No.: 09/941,044

(22) Filed: Aug. 28, 2001

Related U.S. Application Data

(60) Provisional application No. 60/228,541, filed on Aug. 28, 2000.

(51) Int. Cl.[7] ..... H05B 6/70
(52) U.S. Cl. ..... 219/691; 219/693
(58) Field of Search ..... 219/691, 693, 219/692, 695, 696, 700, 750, 709, 762, 748, 219/745, 701, 764; 333/223–233

(56) References Cited

U.S. PATENT DOCUMENTS

| | | | | |
|---|---|---|---|---|
| 2,650,291 | A * | 8/1953 | Kinn | 219/693 |
| 3,110,794 | A * | 11/1963 | Sale | 219/696 |
| 3,474,209 | A * | 10/1969 | Parker | 219/696 |
| 3,555,232 | A * | 1/1971 | Bleackley | 219/693 |
| 3,784,777 | A * | 1/1974 | Soulier | 219/693 |
| 5,958,275 | A | 9/1999 | Joines et al. | |
| 6,020,579 | A * | 2/2000 | Lewis et al. | 219/696 |
| 6,075,232 | A | 6/2000 | Joines et al. | |
| 6,242,726 | B1 * | 6/2001 | Harris et al. | 219/764 |
| 6,396,034 | B2 * | 5/2002 | Drozd et al. | 219/693 |

OTHER PUBLICATIONS

Ahrens, F.W. and Habereger C.C., "Use of New Applicator Design Ideas to Improve Uniformity of Paper Drying Via Microwave Energy," Drying Technology 2001, 19(10), p. 2531-2548.

Hankin, J.W., Leidigh, W.J., and Stephansen, E.W., "Microwave Paper Drying Experience and Analysis," TAPPI Journal, 53(6), 1970, p. 1063-1070.

Jones, P.L., "Dielectric Moisture Profile Improvement of Typical Papers and Boards," Paper Technology, 14(12), 1973, p. 339-343.

Jones, P.L., "High Frequency Dielectric Heating in Paper Making," Drying Technology, 4(2), 1986, p. 217-244.

Jones, P.L., et al., et al., "Moisture Profile Correction of Paper and Board by Radio and Microwave Frequency Fields," Paper Technology, 14(4), 1973, p. 79-84.

Jones, P.L. and Rowley, A.T., "Dielectric Drying," Drying Technology, 14(5), 1996, p. 1063-1098.

Schmidt, P.S., Bergman, T.L., Pearce, J.A., and Chen, P., "Heat and Mass Transfer Considerations in Dielectrically-Enhanced Drying," Drying '92, Book 1, Elsevier Science, 1992, p. 137.

Soininen, M., "Possibilities of High-Frequency Techniques in Paper Industry, " Drying Technology, 6(1), 1988, p.139-156.

(Continued)

*Primary Examiner*—Quang T. Van
(74) *Attorney, Agent, or Firm*—Troutman Sanders LLP; Ryan A. Schneider

(57) ABSTRACT

A microwave heater and/or dryer has a nonlinear or curvilinear relative slot profile geometry. In one embodiment, the microwave dryer has at least one adjustable field modifier making it possible to change the geometry of the heater or dryer when drying different webs. In another embodiment, the microwave dryer provides more uniform drying of a web when the field modifier is adjusted in response to a sensed condition of the web. Finally, a method of microwave heating and/or drying a web achieves a uniform heating and/or drying profile.

12 Claims, 21 Drawing Sheets

MANUALLY ADJUSTED VARIABLE WAVEGUIDE

OTHER PUBLICATIONS

Williams, N.H., "Moisture Leveling in Paper, Wood, Textiles, and Other Mixed Dielectric Sheets," Journal of Microwave Power, 1(3), 1966, p. 73-80.

Metaxas, A.C., "Microwave Heating," Power Engineering Journal, Sep. 1991, p. 237-247.

* cited by examiner

PARAMETERS FOR PAPER DRYING IN A WAVEGUIDE

SCHEMATIC FOR ENERGY BALANCE ON AN INFINITESIMAL GUIDE SECTION

LINEAR SLOT DISSIPATION PROFILE AS A FUNCTION OF STARTING SLOT HEIGHT

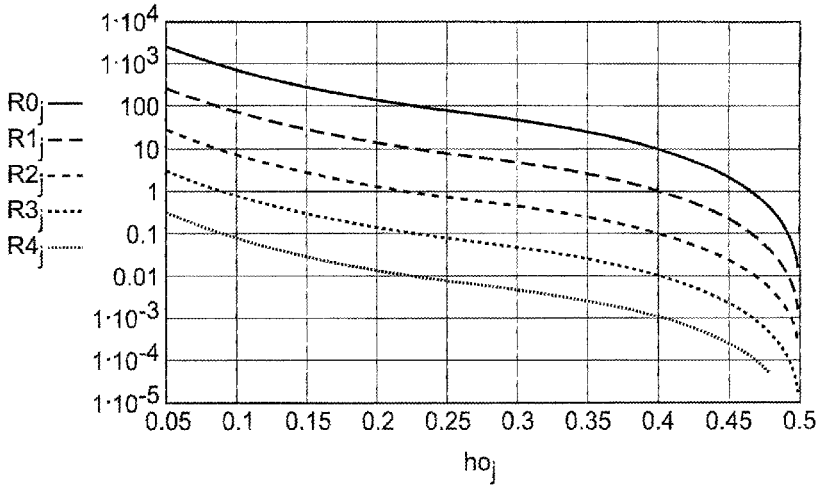

PLOTS OF THE RANGE OF CURVED-SLOT-COMPENSATED WAVEGUIDE AS A FUNCTION OF $h_o/b$, THE RATIO OF THE STARTING SLOT HEIGHT TO THE GUIDE BREADTH. CURVES ARE DRAWN FOR DIFFERENT VALUES OF εr"t IN METERS. THE VALUES OF εr"t PLOTTED ARE LISTED BELOW. THE CURVES DROP TO LOWER VALUES AS εr"t INCREASES.

b=0.072 GUIDE BREADTH IN m $f=2.45\cdot10^9$ FREQUENCY IN Hz $\sin(\pi\cdot min)^2=0.024$ $$\varepsilon rt=\begin{bmatrix}5\cdot10^{-6}\\5\cdot10^{-5}\\5\cdot10^{-4}\\5\cdot10^{-3}\\0.05\end{bmatrix}$$

*FIG. 6*

THE SHAPE OF A SLOT CURVE FOR A GIVEN $\varepsilon r''t$ AND $h_o/b$ $\varepsilon rt := 10^{-4}$ WEB IMAGINARY DIELECTRIC CONSTANT TIMES THICKNESS IN METERS $N := 1000$ NUMBER OF DATA POINTS IN A SLOT CURVE PLOT $j := 0..N-1$ ITERATION PARAMETER FOR RANGE PLOTS $homin := .15$ STARTING RATIO OF h/b $$zmax := \frac{b\cdot\left(\frac{1}{\sin(\pi\cdot homin)^2}-1\right)}{2\cdot\omega\cdot Z\cdot\varepsilon_o\cdot\varepsilon rt}$$ MAXIMUM VALUE OF COMPENSATED z $$z_j := .99\cdot zmax\cdot\frac{j}{N-1}$$ VALUES FOR SLOT HEIGHT PLOTS $$h_j := \left(\frac{t}{\pi}\right)\cdot asin\left[\left(\frac{1}{\sin(\pi\cdot homin)^2}-2\cdot\omega\cdot Z\cdot\varepsilon_o\cdot\frac{\varepsilon rt}{b}\cdot z_j\right)^{\frac{-1}{2}}\right]$$ SLOT HEIGHT VALUES NORMALIZED TO b AS A FUNCTION OF z

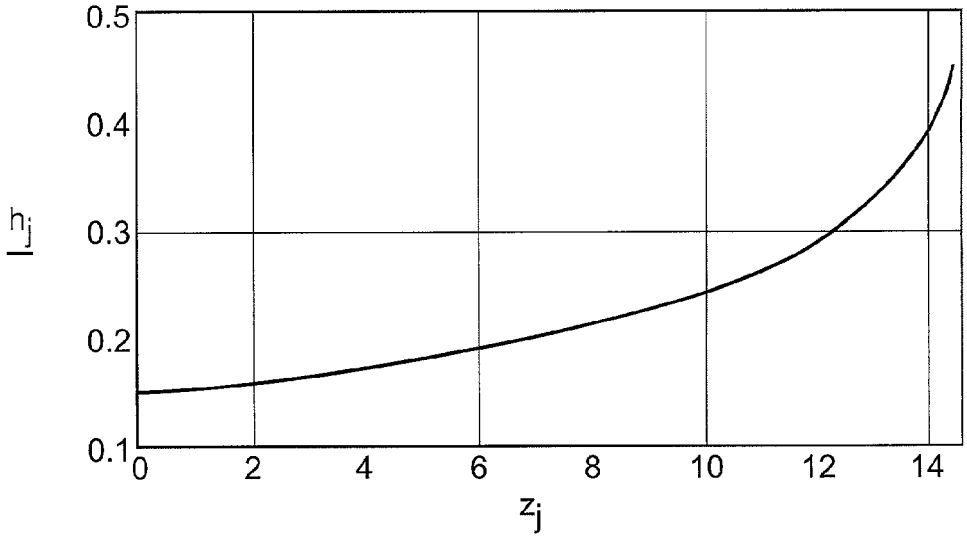

HEIGHT OF THE SLOT DIVIDED BY THE GUIDE BREADTH AS A FUNCTION OF GUIDE LENGTH IN METERS $zmax = 14.443$ RANGE OF COMPENSATION IN METERS

*FIG. 7*

RATIO OF THE E FIELD INTENSITY AT THE GUIDE CENTER TO ITS INITIAL VALUE AS A FUNCTION OF z FOR THE SAME PARAMETERS AS IN THE SLOT SHAPE CURVE.

$$EoS_j := \left(1-2\cdot\omega\cdot Z\cdot\varepsilon_o\cdot\frac{\varepsilon rt}{b}\cdot z_j\cdot\sin(\pi\cdot homin)^2\right)$$

THE RATIO OF Eo SQUARED TO Eoo TO SQUARED AS A FUNCTION OF Z.

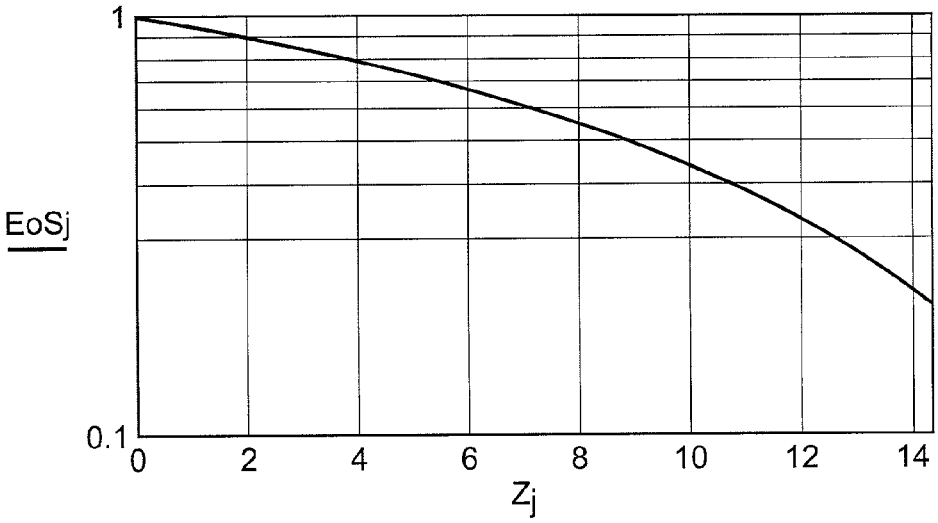

PLOT OF THE RELATIVE CENTER GUIDE FIELD INTENSITY VERSUS GUIDE LENGTH FOR AN IMS OPTIMUM COMPENSATED SLOTTED WAVEGUIDE. THE z AXIS IS IN METERS AND THE y AXIS IS INTENSITY RATIOED TO ITS VALUE AT z=0.

| | |
|---|---|
| $\varepsilon rt=1\cdot10^{-4}$ | WEB IMAGINARY DIELECTRIC CONSTANT TIMES THICKNESS (m) |
| homin=0.15 | INITIAL h/b |
| zmax=14.443 | RANGE OF COMPENSATION IN METERS |

*FIG. 8*

$M := 4$ NUMBER OF WEB RUNS $R = 1.5$ MAXIMUM RATIO OF εrt OPERATION TO εrt DESIGNED $m = 0..M-1$ ITERATION PARAMETER $r_m := R^{\frac{m}{M-1}}$ THE VALUES OF THE RATIO OF THE ACTUAL εrt. TO THE DESIGNED εrt.

$$D0_j := r_0 \cdot \left(1 - 2 \cdot \omega \cdot Z \cdot \varepsilon_o \cdot \frac{\varepsilon rt}{b} \cdot z_j \cdot \sin(\pi \cdot homin)^2\right)^{r_0 - 1}$$

$$D1_j := r_1 \cdot \left(1 - 2 \cdot \omega \cdot Z \cdot \varepsilon_o \cdot \frac{\varepsilon rt}{b} \cdot z_j \cdot \sin(\pi \cdot homin)^2\right)^{r_1 - 1}$$

$$D2_j := r_2 \cdot \left(1 - 2 \cdot \omega \cdot Z \cdot \varepsilon_o \cdot \frac{\varepsilon rt}{b} \cdot z_j \cdot \sin(\pi \cdot homin)^2\right)^{r_2 - 1}$$

$$D3_j := r_3 \cdot \left(1 - 2 \cdot \omega \cdot Z \cdot \varepsilon_o \cdot \frac{\varepsilon rt}{b} \cdot z_j \cdot \sin(\pi \cdot homin)^2\right)^{r_3 - 1}$$

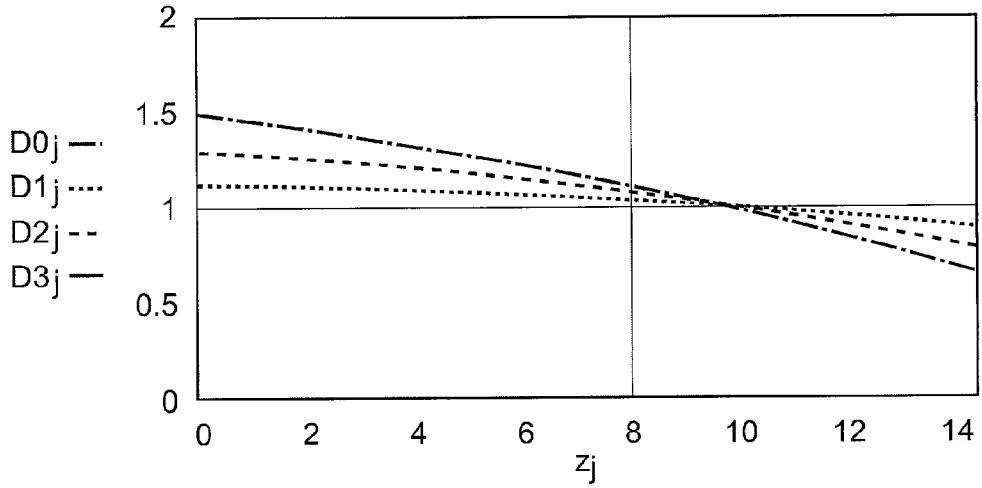

PLOTS OF THE WEB HEAT DISSIPATION RELATIVE TO THE HEAT DISSIPATION AT z=0 IN THE DESIGNED WAVEGUIDE AS A FUNCTION OF WAVEGUIDE LENGTH IN METERS. DIFFERENT CURVES HAVE DIFFERENT RATIOS OF εrt OPERATING TO εrt DESIGNED. THE ACTUAL RATIOS ARE LISTED BELOW AS r.

$\varepsilon rt = 1 \cdot 10^{-4}$ DESIGNED WEB IMAGINARY DIELECTRIC CONSTANT TIMES THICKNESS (m)

$zmax = 14.443$ RANGE OF COMPENSATION IN METERS $homin = 0.15$ INITIAL h/b $$r = \begin{bmatrix} 1 \\ 1.145 \\ 1.31 \\ 1.5 \end{bmatrix}$$

FIG. 9

TWO SERPENTINE MICROWAVE APPLICATOR CONFIGURATIONS:
(a) SHORT AT TERMINATION END; (b) DUMMY LOAD AT TERMINATION END.

DEFINITION OF SLOT (AND PAPER) LOCATION WITHIN THE WAVEGUIDE.

IDEAL DIMENSIONLESS LENGTH VS. INITIAL SLOT HEIGHT

IDEAL SLOT SHAPES fo $h_0/b$ = 0.1,0.25,0.4.

EFFICIENCY VS. IDEAL DIMENSIONLESS LENGTH

EFFICIENCY (AT IDEAL LENGTH) VS. INITIAL HEIGHT

NORMALIZED DRYING RATE FOR IDEAL LENGTH.

THE SLOT HEIGHT PROFILE, h(z), WHICH GIVES UNIFORM DRYING DEPENDS ON THE PAPER BASIS WEIGHT AND ITS MOISTURE CONTENT, $\varepsilon_r$ "t.

THE OPTIMAL SLOT PROFILE IS $$h(z) = (b/\pi)\sin^{-1}[(1/\sin^2(\pi h_0/b)-2Z\omega\varepsilon_0\varepsilon_r''tz/b)^{-1/2}]$$

WHERE $h_0$ REPRESENTS THE SLOT HEIGHT AT THE SOURCE SIDE OF THE WEB AND z IS THE DISTANCE ALONG THE WAVEGUIDE (CD).

*FIG. 17*

PLOTS OF THE OPTIMAL SLOT HEIGHT DIVIDED BY THE WAVEGUIDE HEIGHT AS A FUNCTION OF DISTANCE IN METERS FROM A MICROWAVE SOURCE AT 2.45 GHz IN AN S-BAND WAVEGUIDE. THE SOLID LINE IS DESIGNED FOR A 200 g/m$^2$ BOARD AT 10% MOISTURE, WHEREAS THE DOTTED LINE IS FOR 7% MOISTURE.

MANUALLY ADJUSTED VARIABLE WAVEGUIDE

AUTOMATICALLY ADJUSTED VARIABLE WAVEGUIDE

GEOMETRY FOR WEB MICROWAVE HEATING OR DRYING TO A DESIRED PROFILE IN A WAVEGUIDE

This application claims the benefit of, and incorporates herein by reference, Provisional Application Ser. No. 60/228,541 filed Aug. 28, 2000.

This invention was made with Government support under contract no. DE-FC 07-00ID13872, awarded by the U.S. Department of Energy. The Government has certain rights in this invention.

FIELD OF THE INVENTION

The present invention relates to a slot design for uniform and prescribed, nonuniform web heating and/or drying in a waveguide. Further, the present invention relates to a slotted waveguide including a field modifier. Further, the present invention relates to a slotted waveguide wherein said field modifier is at least one curvilinear surface which is the narrow wall or which is associated with the narrow wall and which improves heating and/or drying uniformity. Still further, the present invention relates to a slotted waveguide having at least one adjustable surface associated with the narrow walls or at least one adjustable narrow wall and which adjusts heating and/or drying profiles across a paper web.

BACKGROUND OF THE INVENTION

As set forth in FIG. 1, a microwave waveguide 10 is generally a system of four walls 30, 40, 50, defining a channel of rectangular cross section along which microwaves propagate. The broad walls 30 are generally perpendicular to the plane of the web 20 and contain a slot 60 through which the web 20 moves. The remaining two walls 40, 50 of the rectangular cross section are the narrow walls. Systems for microwave drying of webs have employed slotted waveguides with the slots along the centerlines of the waveguide broad walls. Typically, the web passes through a linear slot in the midplane of the waveguide, i.e., the centerline of the waveguide broad walls, and optionally travels through a series of serpentine waveguide elements. The prior microwave dryers resulted in non-uniform drying of the web across its width because of the decay in the microwave energy across the waveguide causing the microwave energy to be absorbed differently across the web width.

U.S. Pat. No. 5,958,275 proposed to improve drying uniformity, primarily in non-paper substrates, by linearly varying the position of the web along the guide, i.e., the slot height changes along the waveguide. See FIG. 2. The '275 patent relates to a method for compensating for attenuation when drying planar materials in a side-fed, rectangular waveguide driven in the $TE_{10}$ mode. The web passes through a slotted guide 60 along the short direction, so that the guide electric field is in the plane of the web.

FIGS. 1 and 2 depict a slotted waveguide 10 having a linear opening in the broad wall 30 according to the prior art. The paper web 20 passes through the slotted waveguide 10.

Ignoring the effects of the web and the slot, the electric field amplitude has a half-wave sine variation between the long ends of the guide. The field is null at the guide top wall 40 and the bottom wall 50, and has a peak at the guide center. The field is independent of position in the guide short direction. As the electromagnetic wave propagates down the guide in the z direction, it attenuates due to dissipation in the web. Thus, normally, the intensity of heat generation decreases along the guide. The '275 patent proposes to fix this by linearly varying the position of the web along the guide. The slot height changes along the guide. See FIG. 2. In the beginning, before the wave is much attenuated, the web is near the lower guide wall 50, where the field amplitude is relatively small. As the wave propagates and attenuates, the height of slot changes to move the web toward the center of the guide. Here, the field is relatively stronger which can allow the maintenance of a more uniform intensity of heat dissipation.

The '275 patent discusses the use of a diagonal slot to roughly compensate for attenuation by moving the web to higher electric field regions away from the source. However, when significant compensation is necessary, as can be the case in the production of paper, a straight diagonal slot is insufficient.

It has not been recognized that a slot height that varies in a non-linear manner with cross-machine position (relative to the narrow wall) can be designed to achieve better heating uniformity. In embodiments according to the present invention, this configuration can allow for complete compensation for the reduction in peak electric field strength due to absorption in the web as the waves propagate across the width of the web.

SUMMARY OF THE INVENTION

The present invention provides a microwave waveguide including broad walls separated by, and which are electromagnetically coupled with, at least one field modifier wherein the field modifier has a nonlinear profile.

The present invention further provides a microwave waveguide including at least one adjustable field modifier where the field modifier has a nonlinear profile.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

FIG. 6 illustrates the range of compensation plotted as a function of the $h_o/b$ for webs of different $\epsilon''_r t$.

FIG. 7 illustrates the ideal slot height for constant E field intensity as a function of guide length plotted for $\epsilon''_r t=10-4$ in an S-Band guide at 2.45 GHz.

FIG. 8 illustrates the relative center guide field intensity versus guide length for slotted waveguide.

FIG. 9 illustrates web heat dissipation relative to the heat dissipation at z=0 as a function of waveguide length in meters.

FIG. 17 illustrates the optimal slot profile.

DETAILED DESCRIPTION

Figure 1:
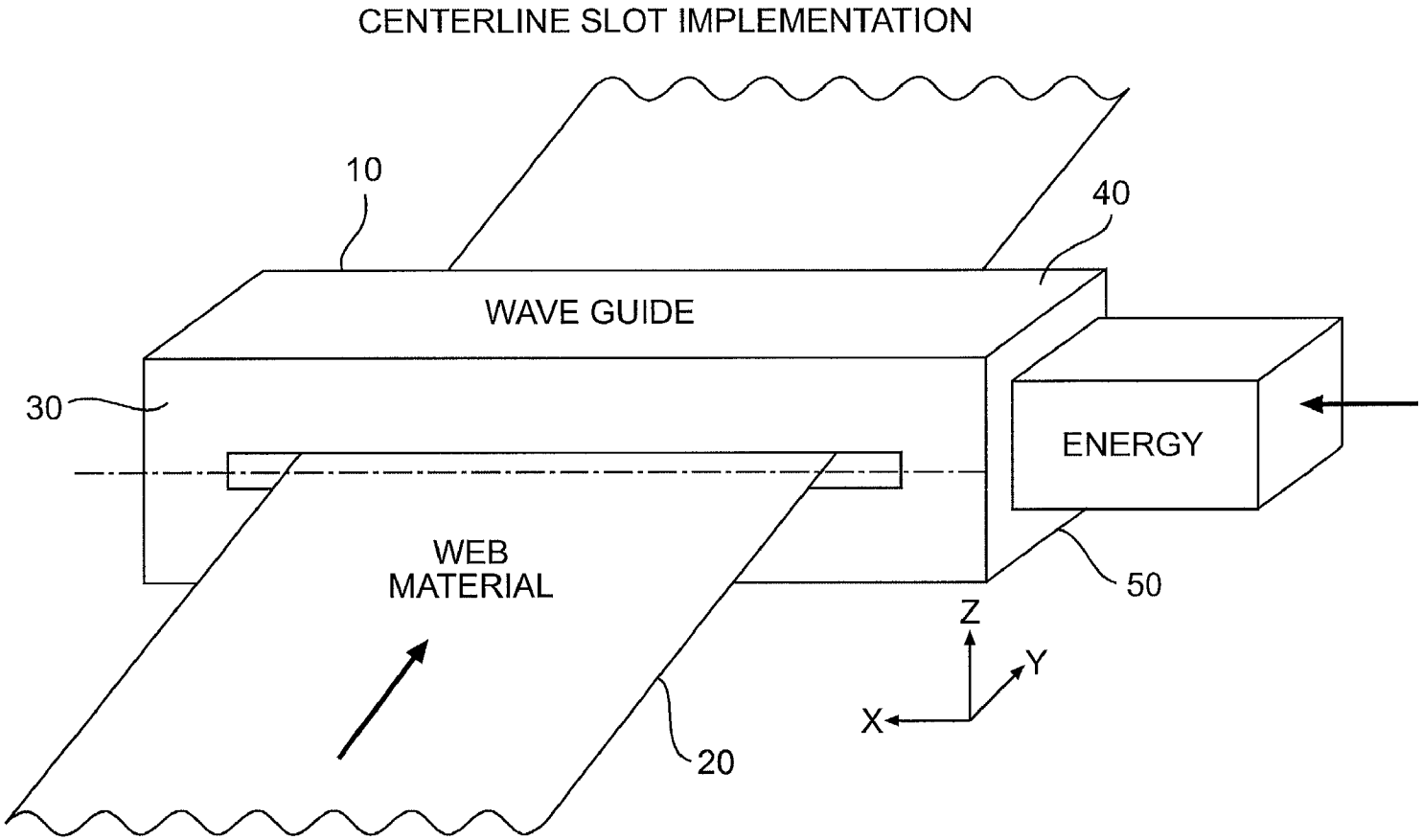
FIG. 1 PRIOR ART
FIG. 1 illustrates a prior art microwave waveguide having slots that are located along the centerline of the broad walls of the waveguide.
Figure 2:
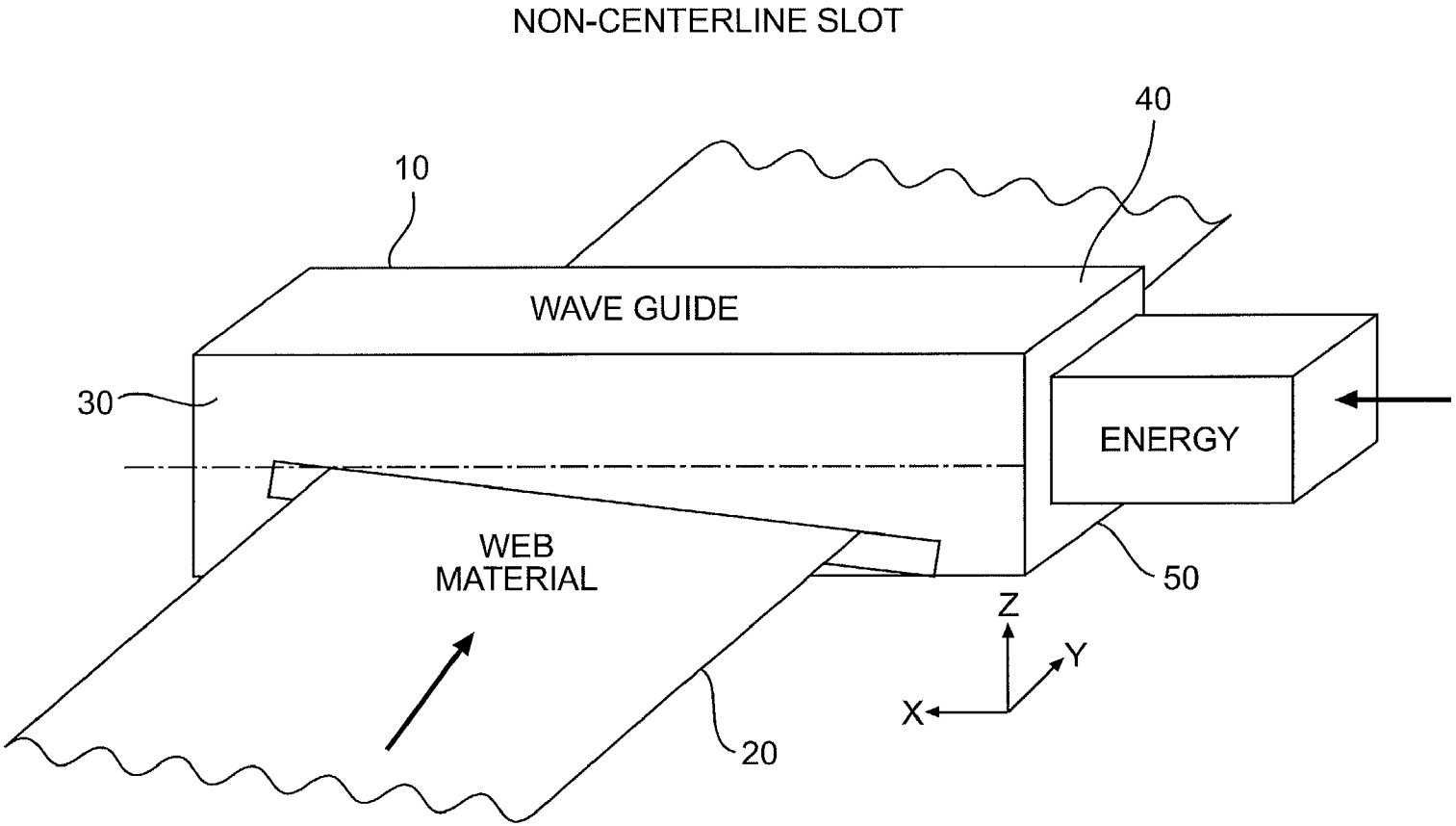
FIG. 2 PRIOR ART
FIG. 2 illustrates a slotted waveguide with a linear non-centerline slot and stationary narrow walls according to the prior art.

The present invention relates to a slotted waveguide for microwave heating and/or drying of a web that provides improved heating and/or drying uniformity. While the present invention is described in terms of achieving heating or drying uniformity in a web, the same principles may be applied to dry or heat a web to another desired moisture profile and is within the scope of the present invention. The present invention also relates to a method of improving the uniformity of drying a web using microwaves through the use of field modifier. As used in the present application the term "field modifier" refers to something which modifies the field at the web surface. Field modifier includes modifications of the waveguide which modify the field profile at the web in a predetermined way. Generally the slot or intrusion has a non-linear profile in order to create a desired filed at the web. For example, the profile of the narrow walls may be modified or an insert with a modified surface may be placed within the waveguide. A conductive, inductive, or capacitive field modifier may be placed within the waveguide to achieve the desired field profile. As described below, the characteristics of a web to be dried result in a moisture profile that can be calculated to assure a prescribed microwave heating profile along the width of the web to be treated.

According to one embodiment of the present invention, the ideal slot profile for any web may be calculated and the geometry of the field modifier configured to provide the uniform heating and/or drying. In one embodiment according to the present invention, the slot profile, which refers to the relative slot profile, may be calculated to provide completely uniform heating and/or drying. However, since the moisture profile can be different for each web or for different segments of the same web, in another embodiment of the present invention, at least one field modifier may be adjustable to accommodate the treatment of different webs using a single waveguide (sequentially or concurrently) or to accommodate variations in the same web.

In still another embodiment according to the present invention, the moisture profile of the web can be evaluated prior to entrance into the microwave waveguide or upon exit from the microwave waveguide. The shape of one or more the field modifiers in the waveguide can be adjusted in response to the sensed condition. The evaluation of the web can be any web property which is indicative of, for example, temperature and/or the moisture profile within the web Appropriate properties for evaluation may include, moisture content, temperature, basis weight. The present invention can be used with any sensors for measuring moisture, temperature and basis weight. Any art recognized sensor may be used with the present invention. Appropriate sensors would be readily apparent to the skilled artisan.

The web can be any planar material including paper, woven or non-woven fabrics, coatings on paper or other substrates and plywood. In one preferred embodiment according to the present invention, the web is paper. Based upon the stricter drying conditions associated with the commercial production of paper, prior art microwave drying methods have suffered from disadvantages associated with non-uniform drying.

Figure 19:
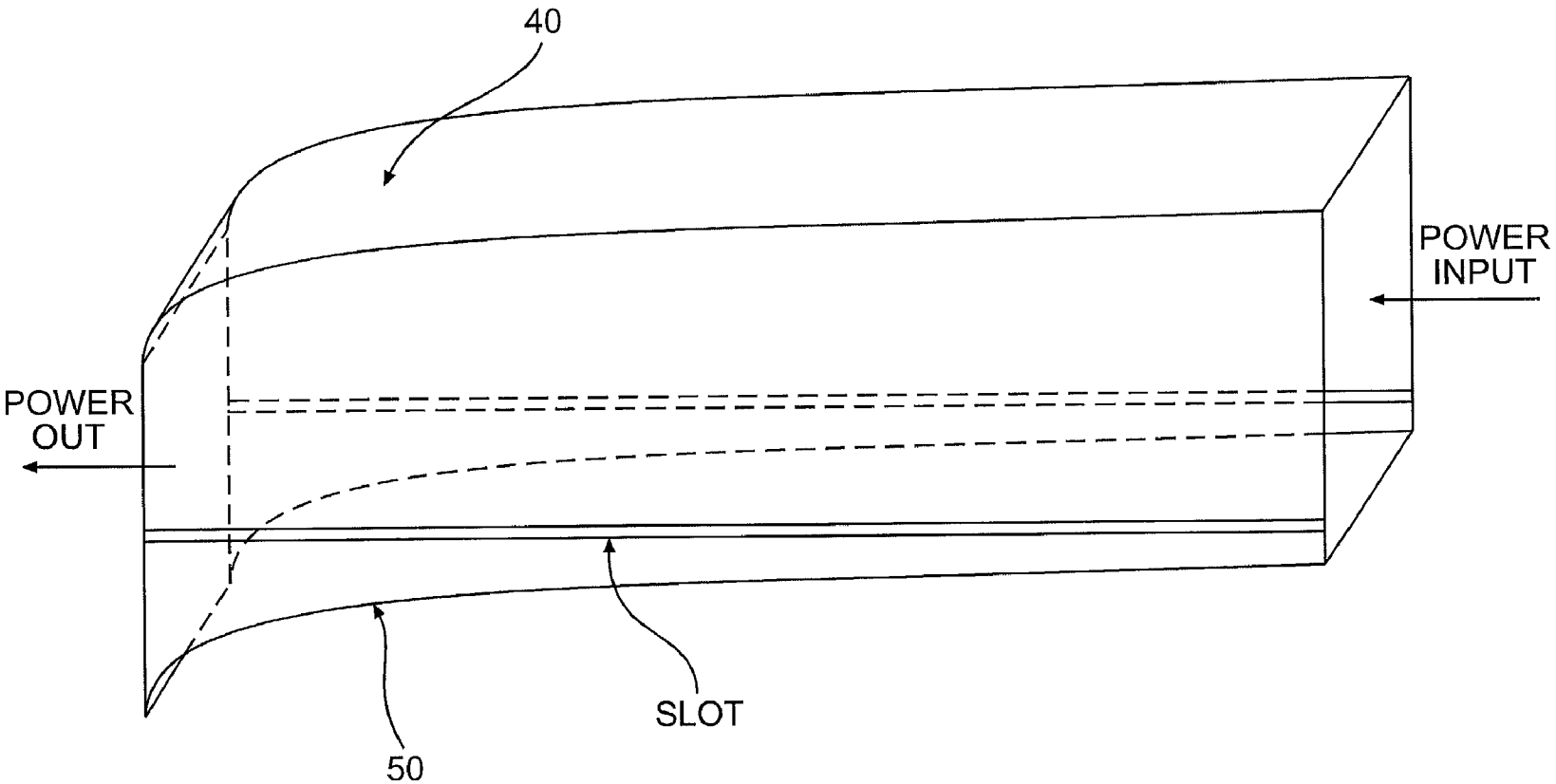
FIG. 19 illustrates one waveguide having a curvilinear relative slot height according to the present invention.

The microwave dryer according to the present invention, preferably has at least one curvilinear field modifier. As shown in FIG. 19, the waveguide has a straight slot and the top 40 and bottom 50 of the waveguide have been modified to be curvilinear and reflect the appropriate relative profile for the desired uniform drying and/or heating of the web.

Figure 20A:
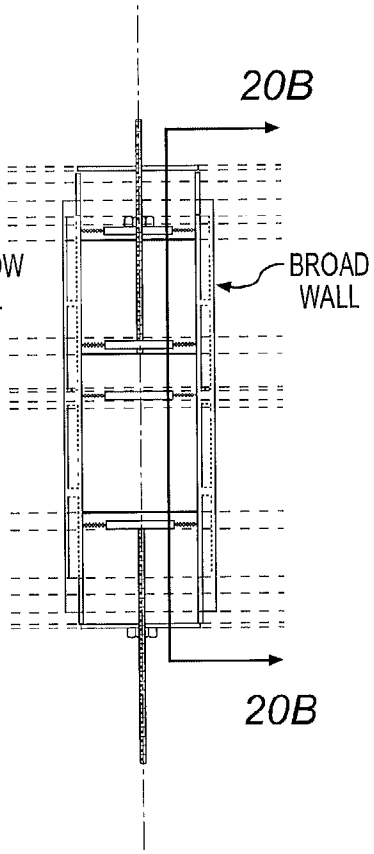
FIG. 20 illustrates a waveguide having at least one adjustable field modifier.
Figure 20B:
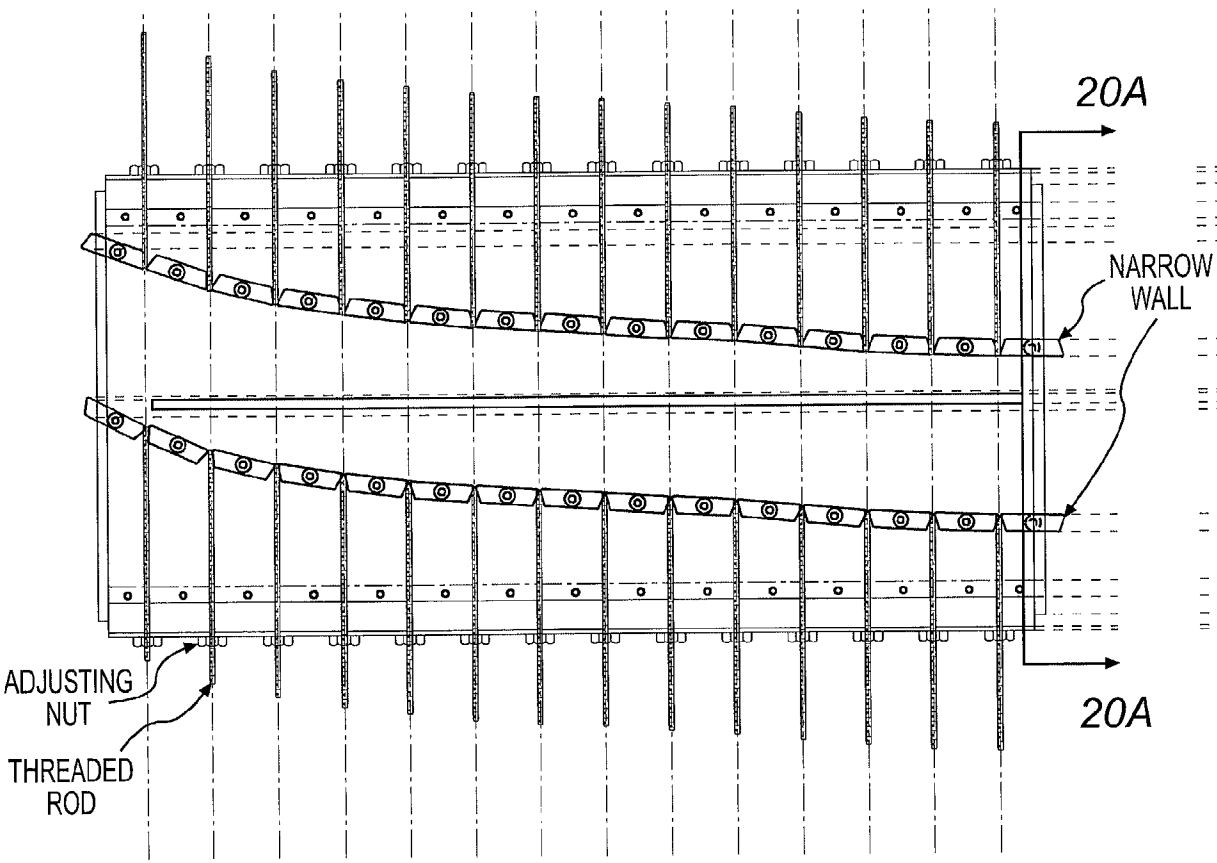
Figures 21A, 21B:
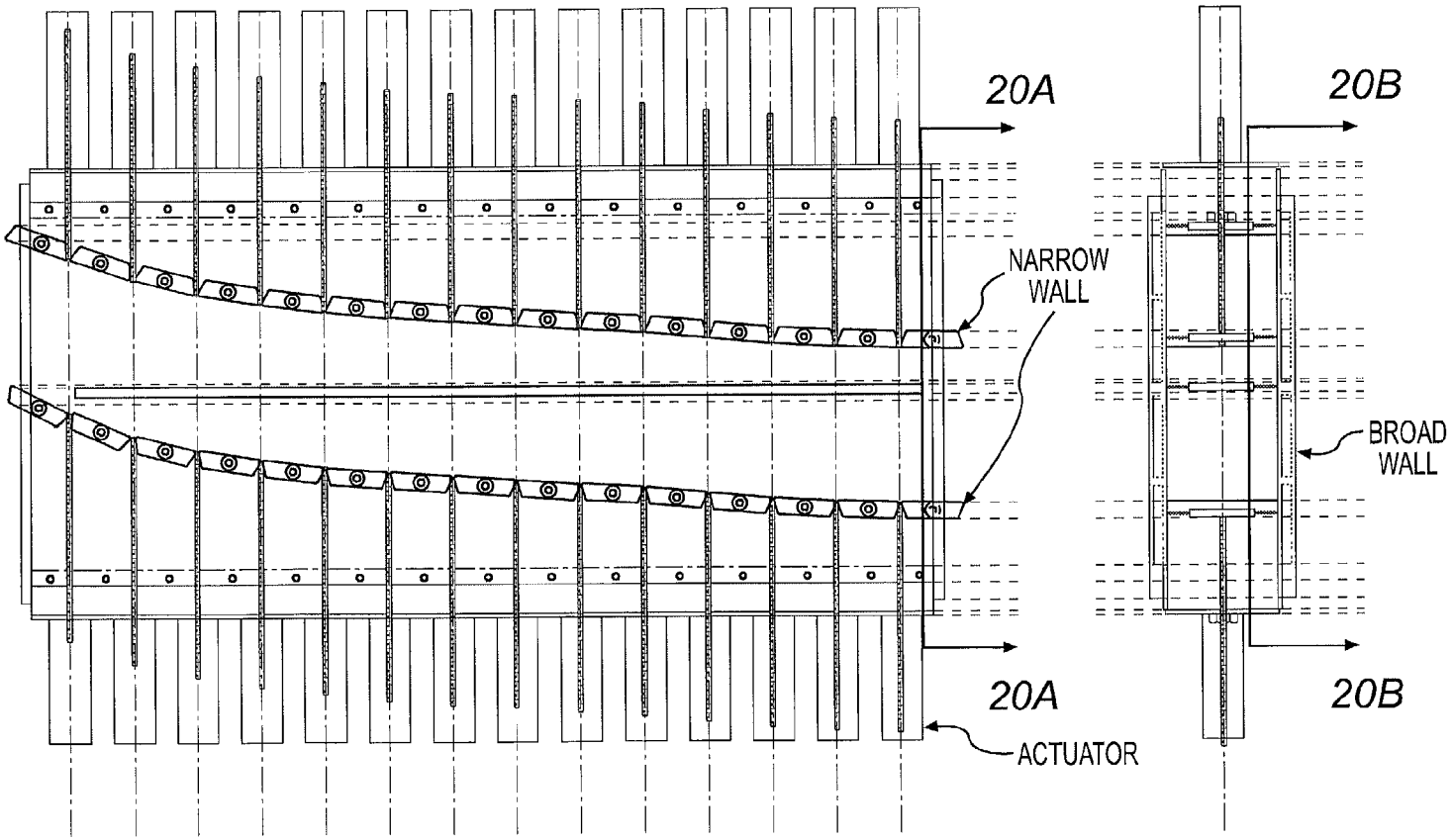
FIG. 21 illustrates a waveguide having actuators for adjusting the at least one field modifier.

If adjustable, the wavequide may be either be manipulated manually, see FIG. 20, or may be equipped with one or more actuators for modifying the shape of the field modifier, see FIG. 21. One or more actuators would be capable of moving the surface of the field modifier, which may be coextensive with the top and/or bottom surfaces of the waveguide, to alter the vertical position of a field modifier surface sufficiently to attain the desired distribution of energy input into the web. In one embodiment according to the present invention, the field modifier is made from a flexible material. In an alternate embodiment, the field modifier is made from one or more rigid, but segmented materials. Any mechanical configuration for adjusting the profile of the field modifier that will allow electromagnetic coupling to be maintained between the field modifier and the broad walls of the waveguide can be used with the present invention. Mechanical configurations other than those described above will be readily apparent to the skilled artisan. Electromagnetic coupling may be maintained using any art recognized method, including, but not limited to physical coupling by, for example, using a conductive grease between the adjustable propagation surface(s) and the broad walls and capacitive coupling.

Both stationary and adjustable microwave waveguides according to the present invention can be used at any point in the web handling process where the use of a microwave heater or dryer is necessary.

It would be readily apparent to the skilled artisan that the desired heating or drying can be achieved based upon modification of the below described calculations. Appropriate heating and/or drying profiles will depend upon the web to be dried and variations in the desired characteristics are readily apparent.

Figure 3:
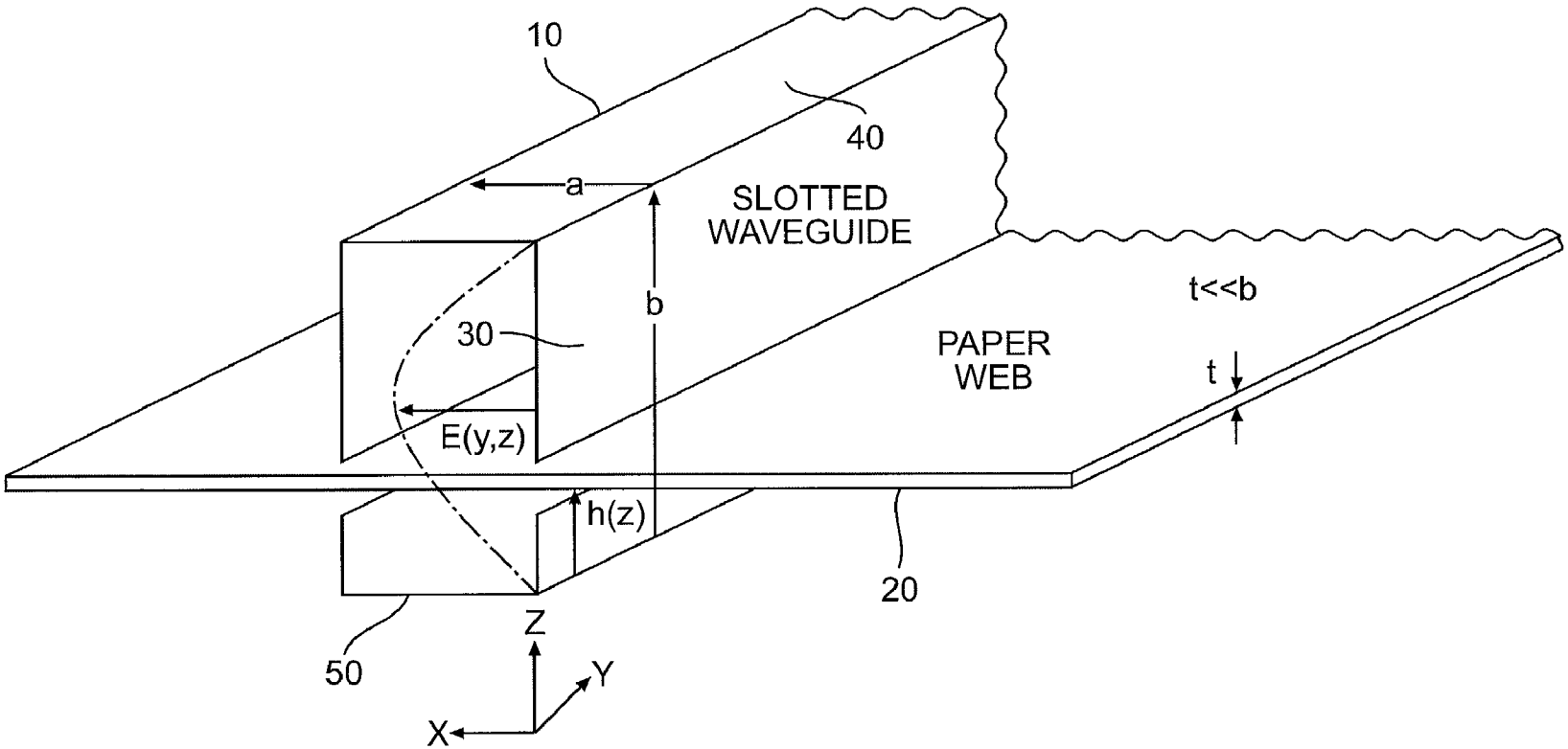
FIG. 3 illustrates a slotted waveguide having a variable slot geometry in accordance with the present invention.

Although the following description is discussed in terms of certain assumptions and equations described herein, the present invention is not limited to such assumptions and equations. The assumptions facilitate a concise discussion of the invention. A system consistent with the present invention provides an improved slot profile design for a waveguide for use in uniform web drying. See FIG. 3. The symbols used herein for the discussion associated with equations 1–13 are as follows:

LIST OF SYMBOLS

- x coordinate axis along the width (short axis) of the waveguide
- y coordinate axis along the breadth (long axis) of the waveguide
- z coordinate axis along the length of the waveguide
- $\epsilon_o$ permittivity of free space:$8.85\times10^{-12}$. farads/m
- $\mu$ permeability of free space: $1.26\times10^{-6}$. henrys/m
- c free space velocity of light: $1/(\epsilon_o\mu)1/2=2.99\times10^{8}$. m/s
- f frequency of excitation
- ω angular frequency of excitation: 2πf
- a width of waveguide
- b breadth of waveguide
- h(z) the distance between the base of the waveguide and the web slot as a function of z
- $h_o$ the initial distance between the base of the waveguide and the web slot
- H magnetic field
- $E_o(z)$ the center guide amplitude of the E field as a function of z
- $E_{oo}$ the center guide amplitude of the E field at z=0
- D(z) the volume intensity of heat dissipation in the web
- $f_c$ cutoff frequency of $TE_{10}$ mode in waveguide: c/2b
- η impedance of free space: $(\mu/\epsilon_o)^{1/2}=377$ Ohms
- Z impedance of $TE_{10}$ mode in waveguide: $\eta/(1-f_c/f)^2)^{1/2}$
- t the web thickness in general
- $t_d$ the designed for web thickness
- $t_o$ the web thickness in the actual operating waveguide
- $\epsilon'_r$ real part of the dielectric constant of the heated web
- $\epsilon''_{rd}$ minus the imaginary part of the dielectric constant of the web as designed
- $\epsilon''_{ro}$ minus the imaginary part of the dielectric constant of the web in operation
- $\epsilon_r$ dielectric constant of the heated web: $\epsilon_r=\epsilon'_r-i\epsilon''_r$
- α(z) amplitude attenuation coefficient The following assumptions are made for the following discussion associated with equations 1–13.

1) Either the waveguide is infinitely long or it is terminated with a perfectly matched load. Either way, reflections from the far end of the waveguide (the end opposite the microwave generator) are ignored.

2) The web thickness is much less than the guide breadth: t<<b.

3) The propagation characteristics of the wave are determined by free space portions of the guide. The web can be ignored in determining the propagation coefficients.

4) Dissipation, on the other hand, is determined by the web. All losses except dielectric losses in the web are forgotten. That is, even though t<<b, losses from current in the guide, radiation out the slot, and heating of steam outside the web are assumed small in comparison to dissipation in the web.

5) There are no internal reflections. The wave is a forward propagating, attenuating $TE_{10}$ wave.

6) The y-dependence of the electric field is a half sine wave peaking in the center of the waveguide. This is a reasonable, first order assumption because the web is inserted in the guide with the free space E field oriented tangential to the web surface. The empty waveguide E field distribution is half sine wave. A boundary condition between neighboring dielectrics is that the tangential electric field is continuous. Thus, the field is continuous across the boundary and the web is considered too thin to generate a significant internal perturbation on the field shape.

Figure 4:
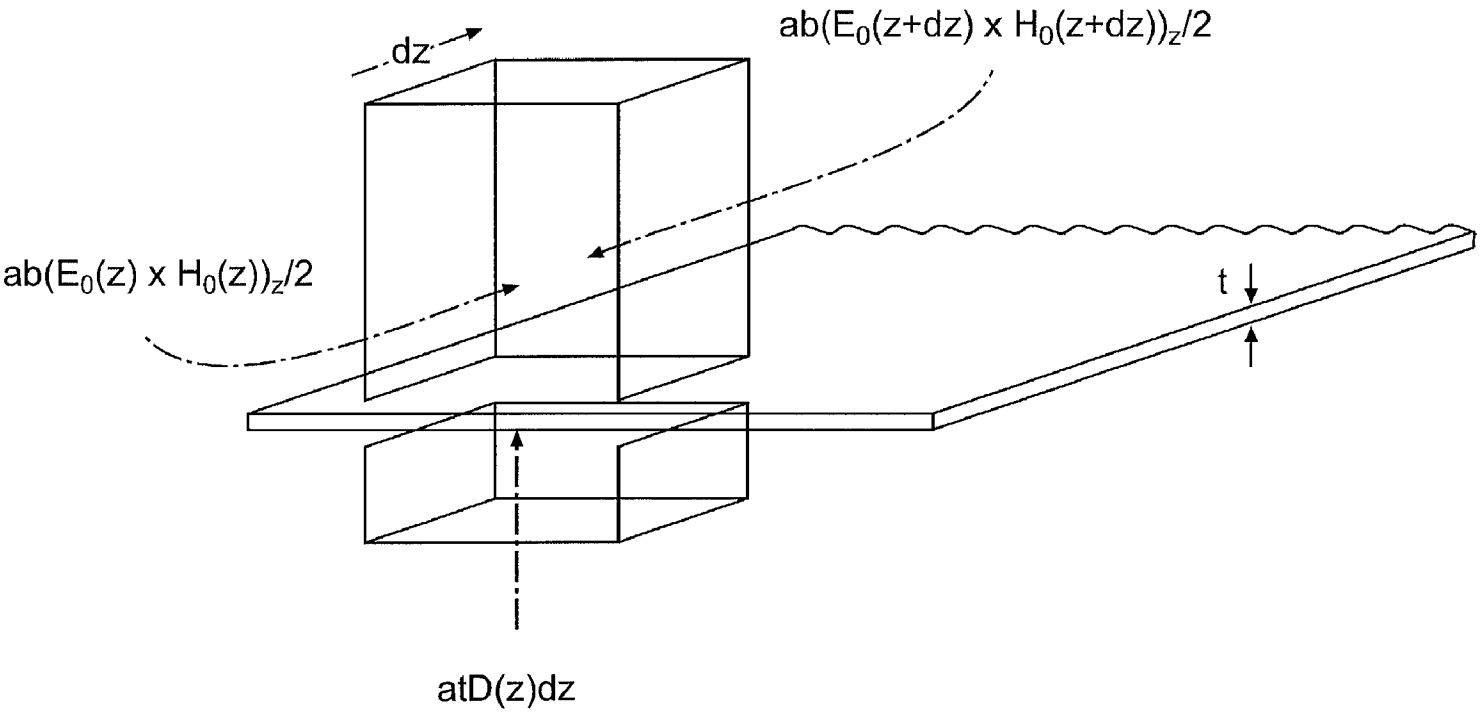
FIG. 4 illustrates a schematic for completing an energy balance on a waveguide which is infinitesimal in the z direction.

In the following discussion, the electric field is assumed to have a sinusoidal variation across the guide in the y-direction. Its center-guide amplitude, $E_o(z)$, decreases in the direction of propagation due to web dissipation. The following finds $E_o(z)$ as a function of web properties and h(z) (the z-dependent slot height), and determines the forms of h(z) to yield constant web dissipation along the guide. An energy balance requirement is used on a guide section that is differential in the z-direction. See FIG. 4. FIG. 4 illustrates a schematic for completing an energy balance on a waveguide which is infinitesimal in the z-direction.

The energy propagating into the differential element is the z-direction component of the surface integral of E×H over the guide surface at z. The energy exiting the differential element is the z-direction component of the surface integral of E×H over the guide surface at z+dz. The energy dissipated in the web is $\omega e_o\epsilon''_r E^2 atdz$ integrated over the breadth of the waveguide. In an empty guide running $TE_{10}$ radiation, the integral of the surface integral of propagated power is $E_o^2ab/2Z$. Since propagation is assumed as in an empty waveguide, the expression at z and z+dz can be used to get net power lost. The field in the web is the same as in the guide; therefore, for the loss term, $E=E_o\sin(\pi h(z)/b$ is used. A standard energy balance gives:

$$(ab/2Z)(E_o(z)^2-E_o(z+dz)^2)=\omega e_o\epsilon r''E_o^2\sin(\pi h(z)/b.)^2 atdz \quad (1)$$

Expanding $E_o$ in a Taylor series and simplifying gives the attenuation coefficient as a function of excitation, guide, and web properties.

$$\alpha(z)=d(In(E_o))/dz=-Z\omega e_o\epsilon''_r(t/b)\sin((\pi h(z)/b.)^2 \quad (2)$$

For uniform heating it is necessary to set h(z), so that the dissipation is not dependent on z. This means that h(z) is designed so dD(z)/dz is zero. The only z-dependent terms in D(z) are $E_o$ and h. Thus, the condition for uniform heating is:

$$d/dz(E_o^2\sin((\pi h(z)/b)^2)=0$$

or $$d(In(E_o))/dz=-(\pi/b)ctn(\pi h(z)/b.)dh(z)/dz \quad (3)$$

Substituting from Eqn. (2) for the attenuation coefficient and simplifying makes Eqn. (3) looks like this.

$$dh(z)/dz=2fZ\epsilon_o\epsilon''_r t\sin((\pi h(z)/b.)^3/\cos((\pi h(z)/b.) \quad (4)$$

Separating variables as a preliminary step to integration yields.

$$dz=[\cos((\pi h(z)/b.)/(2fZ\epsilon_o\epsilon''_r t\sin((\pi h(z)/b)^3)]dh(z) \quad (5)$$

Taking the initial boundary condition as z=0 and $h(0)=h_o$ and doing the integration which turns out to be trivial gives:

$$2fZe_o\epsilon''_r tz=-(b/2\pi)[1/\sin((\pi h(z)/b.)^2-1/\sin((\pi h_o/b)^2] \quad (6)$$

This system compensates only until the slot reaches the center of the guide, or h(z) equals b/2. Thus, the range (R) of the compensation is the value of z when h(z)=b/2. So, in terms of guide, web, and excitation parameters the maximum web width applicable is $$R=(b/2\omega Ze_o\epsilon''_r t)[1/\sin((\pi h_o)/b.)^2-1] \quad (7)$$

So, for a given guide and driving frequency, the range is a function $\epsilon''_r t$ and $h_o/b$. Now, Eqn. (6) for the ideal slot shape function, h(z), is solved. The answer is:

$$\pi h(z)/b=arc\ \sin[(1/\sin((\pi h_o/b)^2-2\omega Ze_o\epsilon''_r tz/b)^{-1/2}] \quad (8)$$

The next step is to integrate Eqn. (2) to get the E field as a function of z. Before doing this, the notation is extended. In estimating the robustness, for heating and drying of the ideal slot shape function, the web is evaluated in a guide designed for other webs. So, from now on, $\epsilon''_{rd}$ and $t_d$ are used to represent the parameters for web in design and $\epsilon''_{ro}$ and to $t_o$ represent the parameters for web in operation. So, the differential equation for $E_o$ in an operating guide is $$d(In(E_o))/dz=-Z\omega e_o\epsilon''_{ro}(t_o/b)\sin((\pi h(z)/b)^2 \quad (9)$$

where h(z) comes from the design parameters, i.e.

$$\pi h(z)/b=arc\ \sin[(1/\sin\ ((\pi h_o/b)^2-2\omega Ze_o\epsilon''_{rd}t_d z/b)^{-1/2}] \quad (10)$$

Now inserting Eqn. (10) into Eqn. (9) gives $$d(In(E_o))/dz=$$

$$-Z\omega e_o\epsilon''_{ro}(t_o/b)[1/\sin((\pi h_o(z)/\ b)^2-2\omega Ze_o\epsilon''_{rd}t_d Z/b)]^{-1} \quad (11)$$

Integrating this produces the following equation for ratio of $E_o$ squared at z to $E_o$ squared at z=0

$$E_o^2/E_{oo}^2=[1-\sin((\pi h_o(z)/b)^2 2\omega Ze_o\epsilon''_{rd}t_d z/b]^{\epsilon''roto/\epsilon''rdtd} \quad (12)$$

Now, the dissipation in the operating guide as normalized to the dissipation in the designed guide at z=0, $D_o(z)/D_d(0)$, is:

$$D_r(z)=\ (\epsilon''_{ro}t_o/\epsilon''_{rd}t_d)(Eo^2/Eoo^2)[\ (\sin(\pi h(z)/b)^2/\sin(\pi h_o/b)^2]$$

$$=(\epsilon''_{ro}t_o/\epsilon''_{rd}t_d)[1$$

$$-\sin(\pi h_o/b)^2 2\omega Ze_o\epsilon''_{rd}t_d z/b]^{\ \epsilon''roto/\epsilon''rdtd-1} \quad (13)$$

NUMERICAL EXAMPLES

Figure 5:
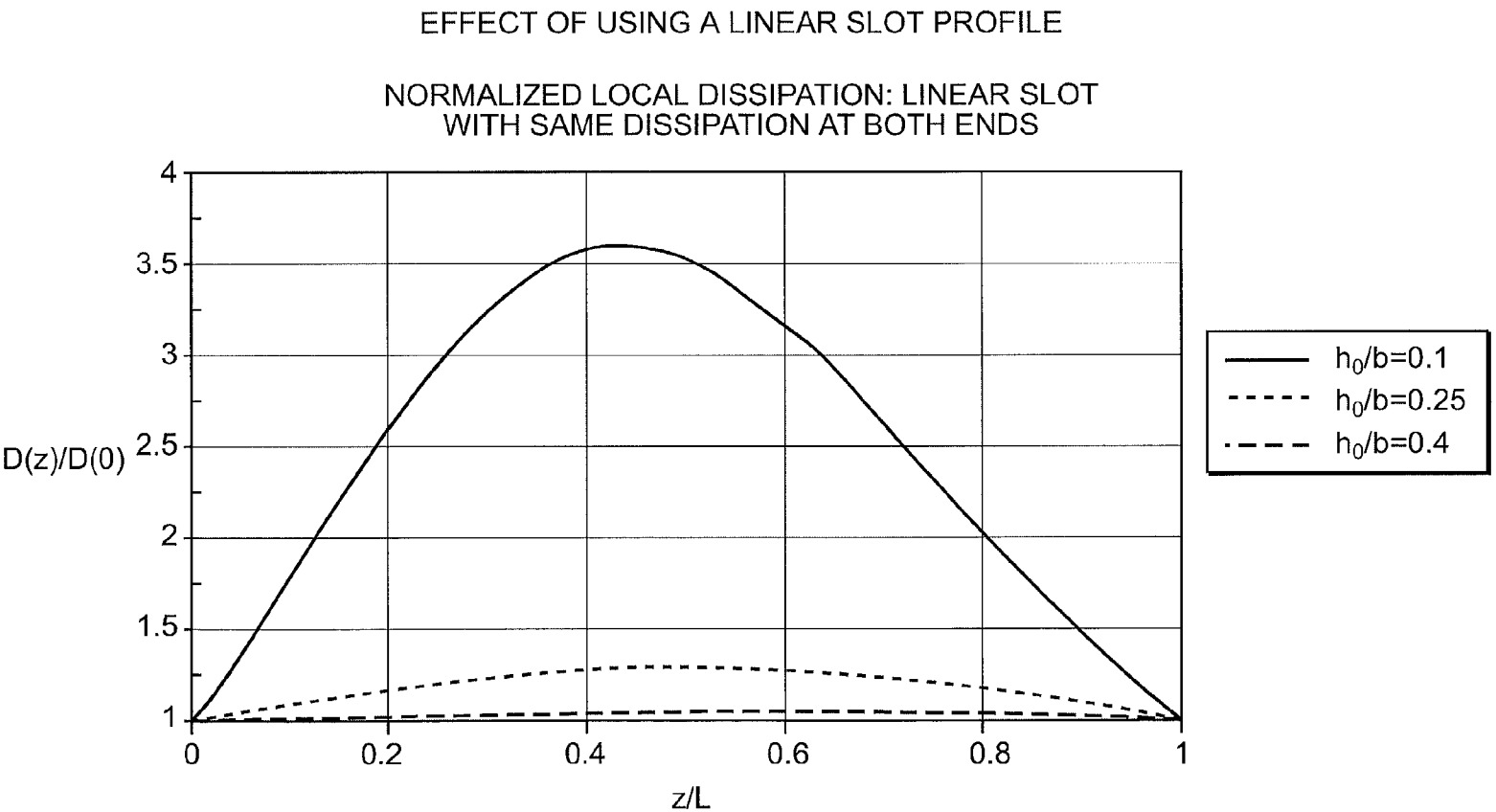
FIG. 5 illustrates a linear slot dissipation profile as a function of starting slot height divided by the waveguide height h(o)/b.

A comparison of straight slot compensation to Eqn (8) curved slot compensation is made in FIG. 5. For maximum drying intensity, the slot should end at the mid-plane (h=b/2). FIG. 5 presents the dissipation profiles for straight slot compensations that force the drying rates to be equal at the beginning and end of the waveguide where h=b/2. The degree of compensation increases and $h_o$ approaches zero. When there is little absorption across the waveguide and $h_o$ can be nearly b/2, the linear slot solution is adequate. However in the more practical applications requiring high drying rates and low initial slot heights the straight slot performs poorly. In contrast, the Eqn. (8) curved slot gives substantially complete or complete compensation for all cases.

The following demonstrates the range of compensation for drying paper webs is sufficient. With practical waveguide design parameters, the compensation should extend the width of a typical paper machine (about 10 m). In FIG. 6, the range of compensation is graphed as a function of $h_o/b$ for webs of different $\epsilon''_r t$. The system discussed operates in an S-Band waveguide at 2.45 GHz and allows $\epsilon''_r t$ to vary over a reasonable range corresponding to thin, dry papers to thick, heavy papers.

FIG. 7 presents a slot curve. From inspection of Eqns. (7) and (8), it can be concluded that this curve is independent of $\epsilon''_r t$ if h(z) is plotted with z normalized to the range of compensation. So, FIG. 7 can be considered a universal curve for S-Band 2.45 GHz operation.

FIG. 8 presents centerline field intensity for the perfectly compensated ease as a function of guide length plotted for $\epsilon''_r t=10^{-4}$ in an S-Band guide at 2.45 GHz. FIG. 9 gives the power dissipation intensity as a function of z for the designed web and for webs with $\epsilon''_r t$ different from the expected. Notice that the percentage of cross web variability is roughly equal to the percentage deviation of $\epsilon''_r t$ from the designed value.

Figure 10A:
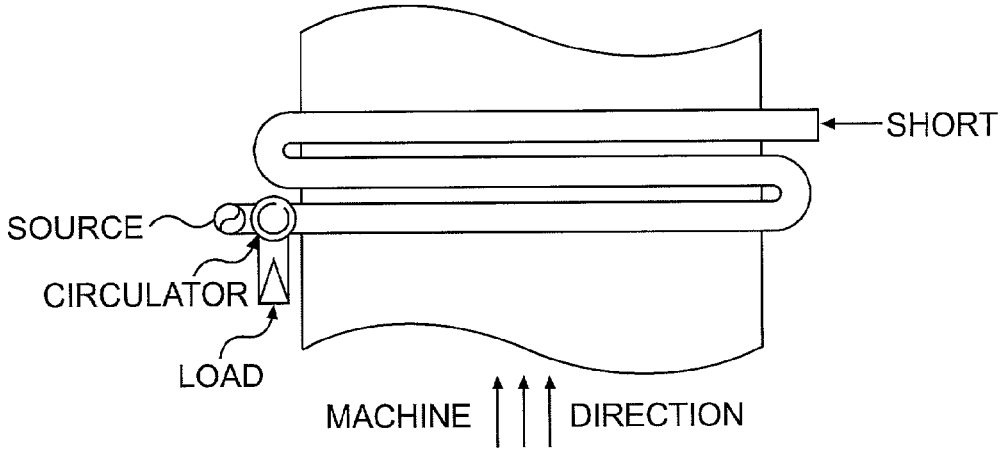
FIG. 10 illustrates two configurations for serpentine, slotted waveguide applicator systems according to the present invention.
Figure 10B:
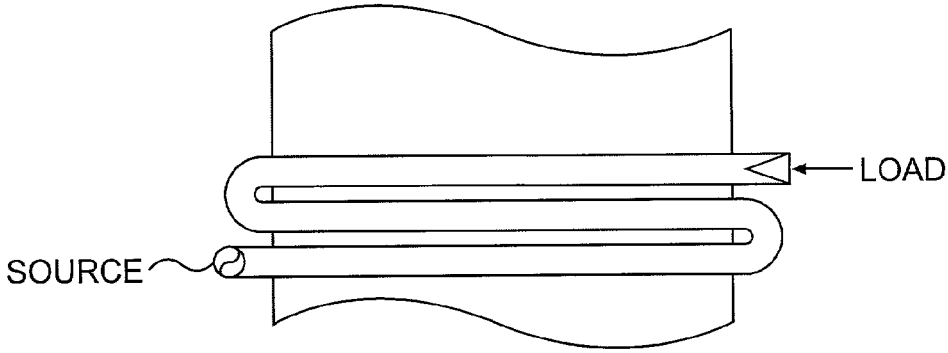

Two configurations for serpentine, slotted waveguide applicator systems are depicted in FIG. 10. Type (a) has a reflector (short) at the termination end, and a circulator and load at the supply end, while type (b) has a dummy load at the termination end. In type (a), energy not absorbed in the web after travel from the source to the short will be reflected, and have the opportunity to be partially absorbed before it reaches the load. This design will have a standing wave along the applicator, making it challenging to achieve uniform heating of the web. Type (b) is discussed further herein and will (ideally) have no reflections and no standing wave pattern. Note that a special case of each of the serpentine systems in FIG. 1 would be a corresponding single-pass version. In the analysis to follow, the single-pass system will be the initial focus, but the results will then be extended to the multi-pass configuration.

The slotted waveguide configuration having slots that are located along the centerline of the broad walls of the waveguide has been favored up until recent times. However, it has now been recognized that the use of slots that are not necessarily located along the centerline should have an important advantage, relative to the possibility of achieving uniform energy absorption across the whole width of the paper machine. Although use of off-center slots raises the issue of escape of electromagnetic energy, the use of suitable choke flanges should result in negligible losses. Considering first the traditional on-centerline approach, if absorption is occurring, the peak electric field will progressively decrease with cross-machine position. Since dissipation in the material is proportional to the square of the field strength, uniformity will be impossible. On the other hand, with the new approach, one could start the slot (at the supply end of the applicator) off-center, where the field is lower, and gradually bring it toward the center as a function of cross-machine position.

The following are analytical results for design of slotted waveguides for uniform web heating via microwave energy.

The approach to be used here is to apply microwave heating principles, with a minimal number of approximations, to the case of a single-pass slotted waveguide applicator having power supplied at one end and a load at the other. The analysis follows a z-directional course along the moist web to account for the local rate of conversion of electromagnetic energy to thermal energy. The discussion focuses on the heating problem (i.e., assuming that the moisture and temperature-dependent loss coefficient is specified). Since multiple passes and even multiple serpentine units would likely be needed to accomplish heating/drying over a useful moisture range, at high machine speeds, the results derived here should serve as a suitable 'building block.' The analysis may be extended to the design of applicators with a reflector (short) or other specified termination, instead of a load at the end opposite the power source.

The following notation conventions are for equations 14–38.

NOTATIONS FOR EQUATIONS 14–38

| | | |
|---|---|---|
| a | narrow dimension of waveguide cross-section | m |
| b | broad dimension of waveguide cross-section | m |
| BW | paper (dry) basis weight | $g/m^2$ |
| $D_v$ | volumetric dissipation rate in moist paper | $W/m^3$ |
| D' | dissipation rate per unit distance along guide | W/m |
| E | electric field | V/m |
| f, $f_0$ | microwave frequency, cutoff frequency | GHz |
| h | elevation of slot above bottom of waveguide | m |
| L | active length of waveguide | m |
| $L_0$ | absorption length (equation 11) | m |
| $\dot{m}_D''$ | drying rate | $kg/(m^2\text{-}s)$ |
| $m_r$ | moisture ratio | g water/g solid |
| $m_w''$ | water loading | $g/m^2$ |
| N | number of passes | — |
| P | electromagnetic power | W |
| t | paper thickness | m |
| y | distance above bottom of waveguide | m |
| z | distance along waveguide | m |
| Z | waveguide impedance = $377/[1-(f_0/f)]^{1/2}$ | ohm |
| Greek | | |
| $\alpha$ | mean absorption coefficient (equation 10) | 1/m |
| $\epsilon_0$ | permittivity of free space ($8.85 \times 10^{-12}$) | farads/m |
| $\epsilon_r''$ | dielectric loss coefficient | — |
| $\lambda$ | latent heat of vaporization | kJ/kg |
| $\eta$ | efficiency | |
| $\omega$ | angular frequency | 1/s |
| $\Delta\hbar$ | change in normalized slot height = ½ − $\hbar(0)$ | m |
| Subscripts | | |
| ideal | ideal slot height variation case | |
| in | waveguide inlet (power input end) | |
| linear | linear slot height variation case | |
| max | maximum, at a given cross-section | |
| out | waveguide exit (load end) | |
| overall | for all N passes | |
| p | paper | |
| PM | paper machine | |
| Ref | reference value | |
| 1-pass | one (first) pass | |
| water | water only | |
| over bar | dimensionless quantities, defined in text by equations 25, 26, 27, 35 | |

Figure 11:
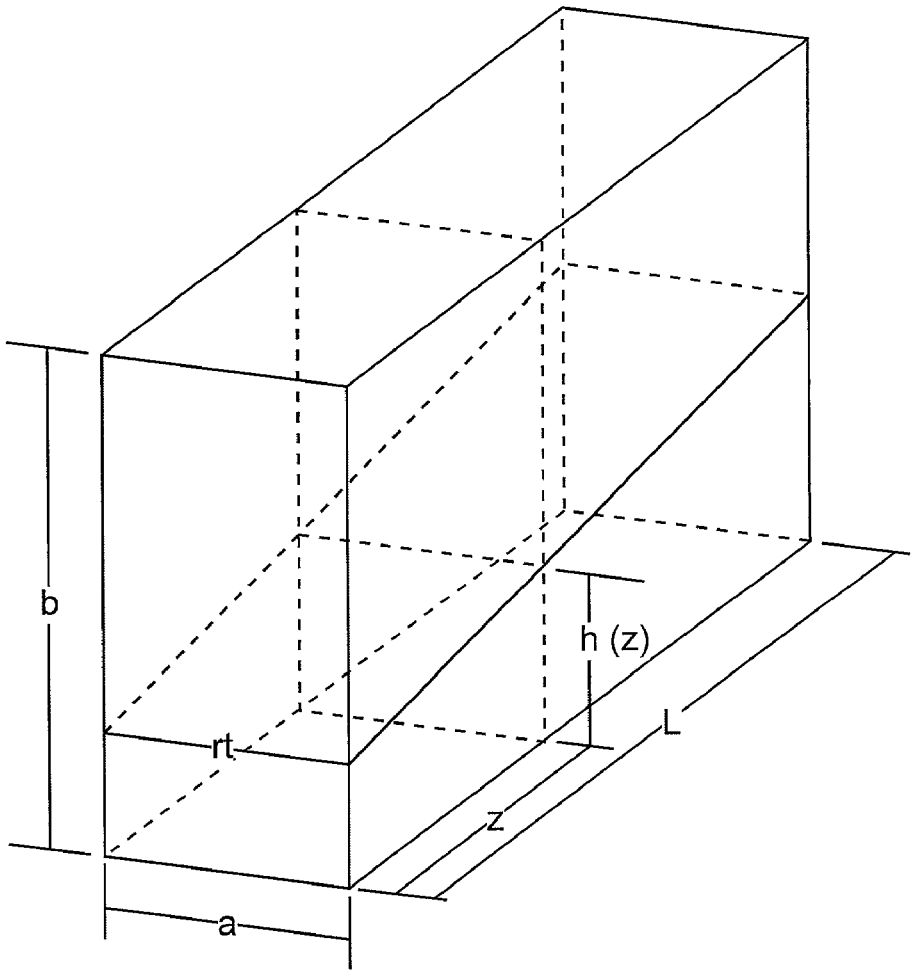
FIG. 11 illustrates the slot location within the waveguide. The cross-machine coordinate is z and h(z) is the local elevation of the slot above the bottom of the waveguide. The overall active cross-machine length is L.

Principles and Approximations—The approximation of an ideal system in which the only loss of electromagnetic power is that due to dissipation in the wet paper (i.e., no dissipation in the waveguide walls or leakage out the slot) seems reasonable. The rate of dissipation per unit volume of web is given by:

$$D_v=\omega\epsilon_o\epsilon''_r E_p^2(z) \tag{14}$$

where Ep(z) is the electric field at the location of the web and slot, h(z) (see FIG. 11). Multiplying by the web cross-sectional area (at) (dimensions defined in FIG. 11) yields the total rate of dissipation per unit z-directional distance:

$$D'(z)\equiv atD_v(z)=at\omega t_o\epsilon''_r E_p^2(z) \tag{15}$$

At the waveguide cross-section located at any z, the total electromagnetic power propagating into that cross-section is P(z). The law of conservation of energy is:

$$\frac{dP(z)}{dz}=-D'(z) \tag{16}$$

Since paper is a very thin material compared to the waveguide height (b), a good approximation for the E-field distribution at a waveguide cross-section at any z is:

$$E(y,z)=E_{max}(z)\sin\left(\frac{\pi y}{b}\right) \tag{17}$$

$E_{max}(z)$ is the amplitude and occurs at the mid-plane (y=b/2). If the thin wet web is located at the elevation:

$$y=h(z) \tag{18}$$

it would thus experience an E-field:

$$E_p(z)=E_{max}(z)\sin\left(\frac{\pi h(z)}{b}\right) \tag{19}$$

Because of the sinusoidal variation in E, the total electromagnetic power propagating in the z-direction inside the waveguide at the cross-section located at any z is adequately approximated by:

$$P(z)=\frac{ab}{2Z}E_{max}^2(z) \tag{20}$$

where Z is the waveguide impedance (not dependent on the wet web properties).

No additional principles are needed in order to examine how well various candidate paper elevation profiles [h(z)] can experience a degree of uniformity of heating (i.e., of dissipation of electromagnetic power). Of course, the elevation profile shapes that would provide complete uniformity can be determined.

To facilitate the analysis, equations 15, 16, 19 and 20 can be combined to achieve a differential equation that describes the variation of E-field experienced by the paper with position, z:

$$\frac{d}{dz}\left(\frac{E_p^2(z)}{\sin^2\left(\frac{\pi h(z)}{b}\right)}\right)=-\frac{2tZ\omega t_0\varepsilon''_r}{b}E_p^2(z) \tag{21}$$

The general solution of equation 21 is:

$$E_p(z)=\left(\frac{\sin\left(\frac{\pi h(z)}{b}\right)}{\sin\left(\frac{\pi h(0)}{b}\right)}\right)E_p(0)e^{-\alpha z} \tag{22}$$

where:

$$\bar{\alpha}z = \int_0^z \left(\frac{tZ\omega Z_0\varepsilon_r''}{b}\right)\sin^2\left(\frac{\pi h(z)}{b}\right)dz \tag{23}$$

$h(0)$ = paper elevation at the inlet ($z = 0$)

$E_p(0)$=E-field at the inlet, at y=h(0), calculable from the input power $P_{in}$=P(0), using equations (19) and (20).

It is useful to recognize the grouping of parameters:

$$L_0 \equiv b/(Z\omega/_0\epsilon'',t) \tag{24}$$

as representing a meaningful length scale for absorption of microwave energy by the moist web. Normalizing the waveguide (single-pass) length by this quantity defines a dimensionless waveguide length parameter:

$$\bar{L} \equiv L/L_0 \tag{25}$$

Intuitively, a large $\bar{L}$ would correspond to a length over which the moist web absorbs much of the input energy. A dimensionless position can be introduced along the waveguide as:

$$\bar{z} = z/L \tag{26}$$

Furthermore, the slot (and web) location can be normalized by height b:

$$\bar{h}(\bar{z}) = h(\bar{z})/b \tag{27}$$

Using equations (25–27), equation (23) can be rewritten:

$$\bar{\alpha}z = \int_0^{\bar{z}} \bar{L}\ \sin^2(\pi\bar{h}(\bar{z}))d\bar{z} \tag{28}$$

It can be noticed that, for the special case of h(z)=constant:

$$E_p(\bar{z}) = E_p(0)e^{-\bar{\alpha}z} \tag{29}$$

In this case, $\bar{\alpha}$ is constant (but dependent on the value selected for h(0), due to the $\sin^2$ term in equation 28). However, in the general case, h(z) not constant, $\bar{\alpha}$ varies with z, and there is also a variable factor before the exponential term in equation 22.

It is of interest to know the slot design [h(z)] that provides uniform heating of the web across the width of the web machine. This corresponds to the special case of $E_p(z)$ =constant. The solution of equation 21 (in dimensionless variables) is then:

$$\bar{h}(\bar{z}) \equiv h(\bar{z})/b = \frac{1}{\pi}\sin^{-1}\left\{\left[\frac{1}{\sin^2\left(\frac{\pi h(0)}{b}\right)} - 2\bar{L}\bar{z}\right]^{-\frac{1}{2}}\right\} \tag{30}$$

It is useful to recognize that, for a given initial slot height ($\bar{h}(0)$), there is a maximum value of $\bar{L}$ that can be used for uniform heating via the variable slot height technique. This value corresponds to $\bar{h}(\bar{z}=1)=0.5$, signifying that the slot ends at the mid-plane of the waveguide. This "ideal dimensionless length" is, from equation (30):

$$\bar{L}_{ideal} = \frac{1}{2}\left(\frac{1}{\sin^2(\pi\bar{h}(0))} - 1\right) \tag{31}$$

Figure 12:
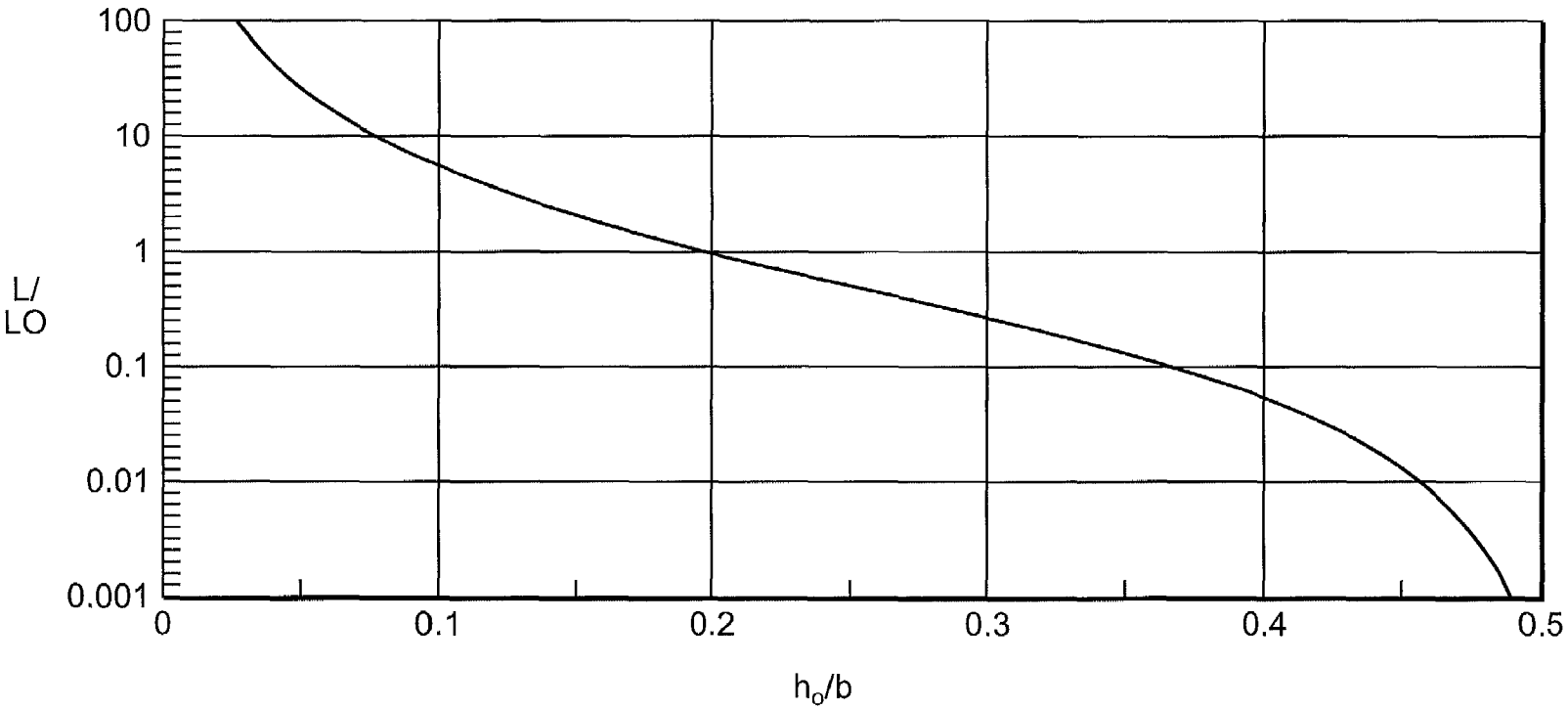
FIG. 12 plots ideal dimensionless length versus initial slot hight.

The variation of ideal length with initial slot height is shown in FIG. 12.

Figure 13:
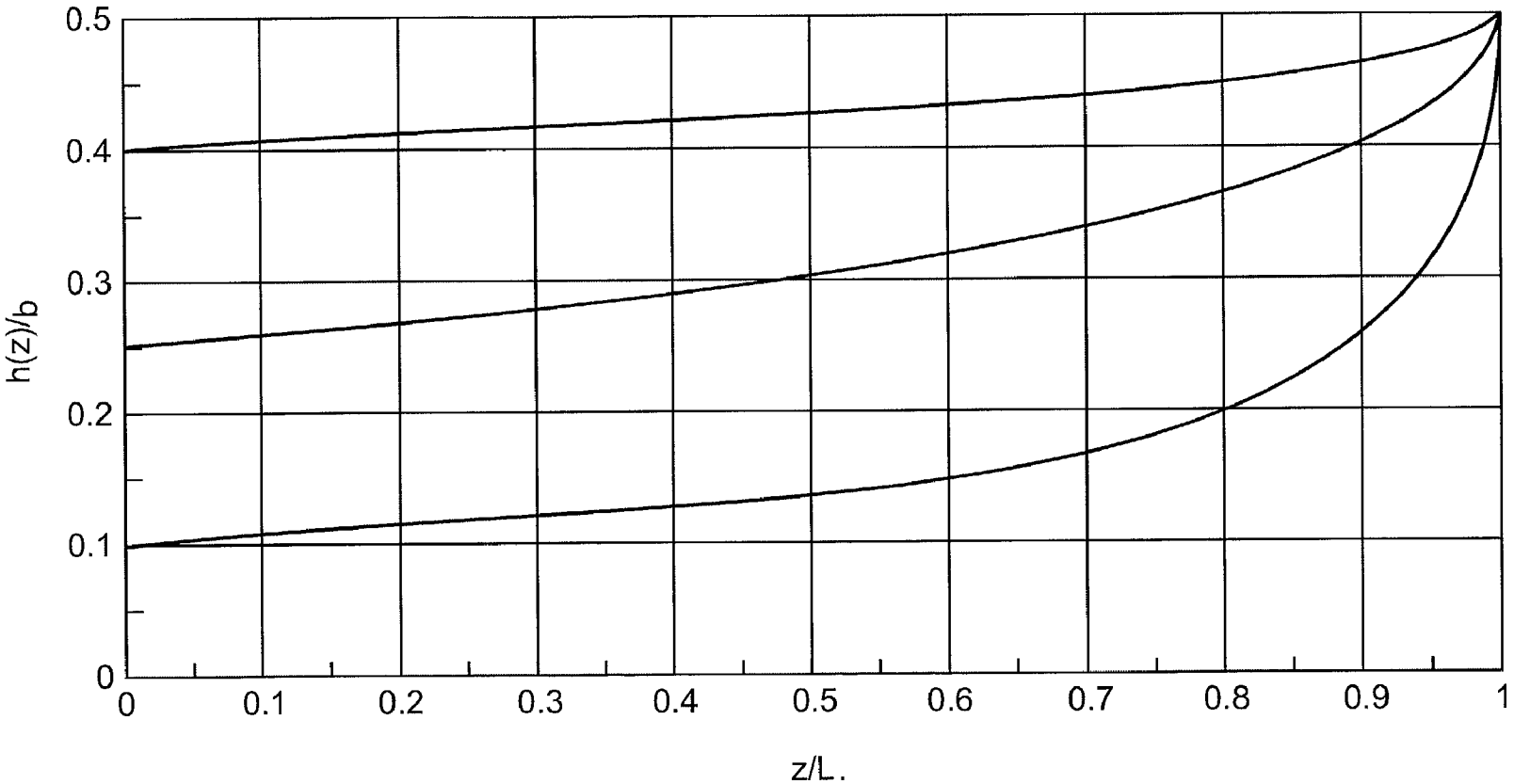
FIG. 13 plots ideal slot shapes at various h(o)/b values.

Example slot shapes, computed by inserting the ideal length values into equation (30), are shown in FIG. 13. Note that slots starting farther from the midplane have much more curvature near the outlet end of the waveguide. They also provide more complete absorption of the input power by the web. The completeness of absorption can be measured by an efficiency, defined as:

$$\eta = (P_{in} - P_{out})/P_{in} \tag{32}$$

For ideal slots (uniform absorption and termination at the mid-plane), it can be shown that:

$$\eta = 2\bar{L}_{ideal}/(1+2\bar{L}_{ideal}) \tag{33}$$

Figure 14:
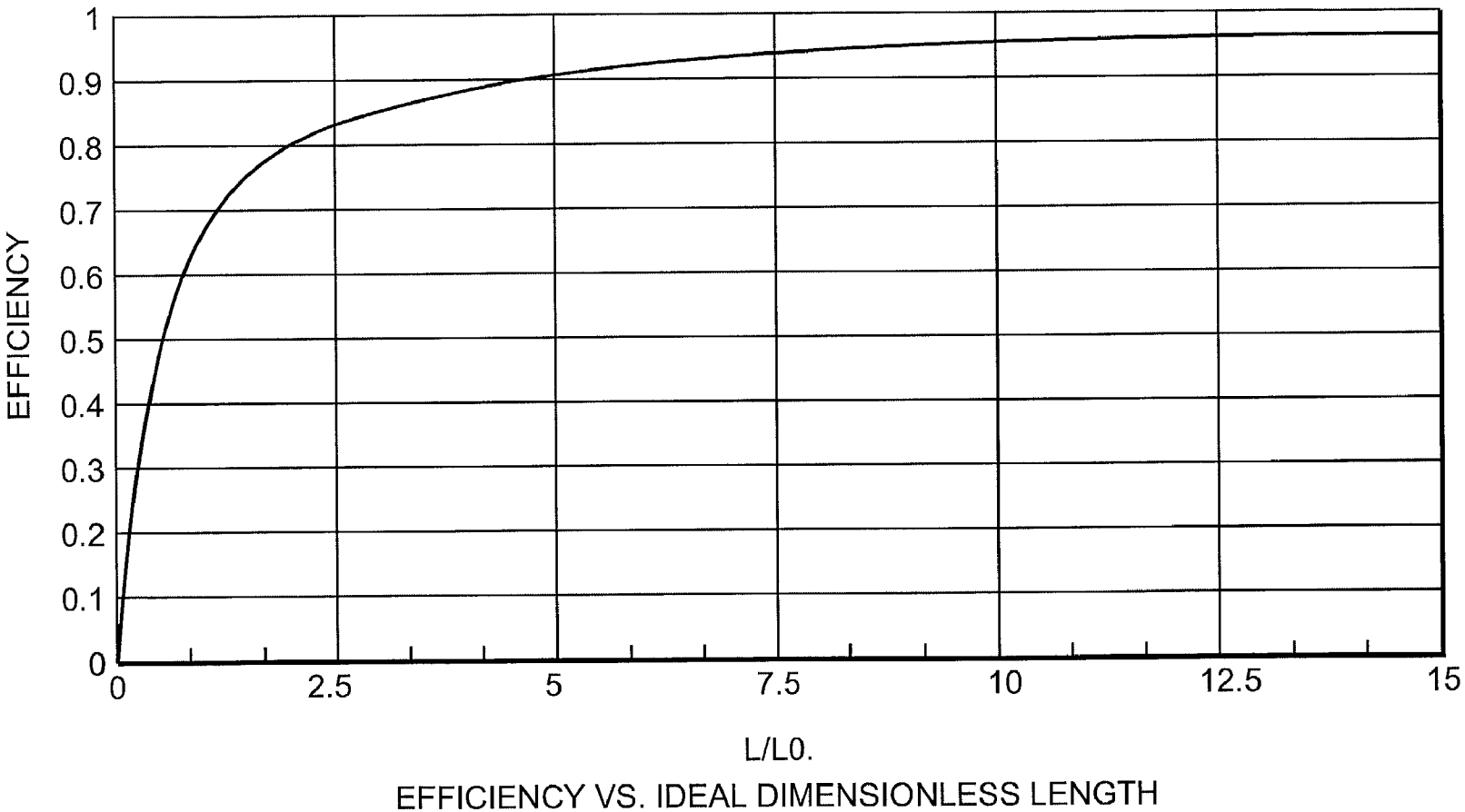
FIG. 14 illustrates efficiency as a function of ideal dimensionless length.
Figure 15:
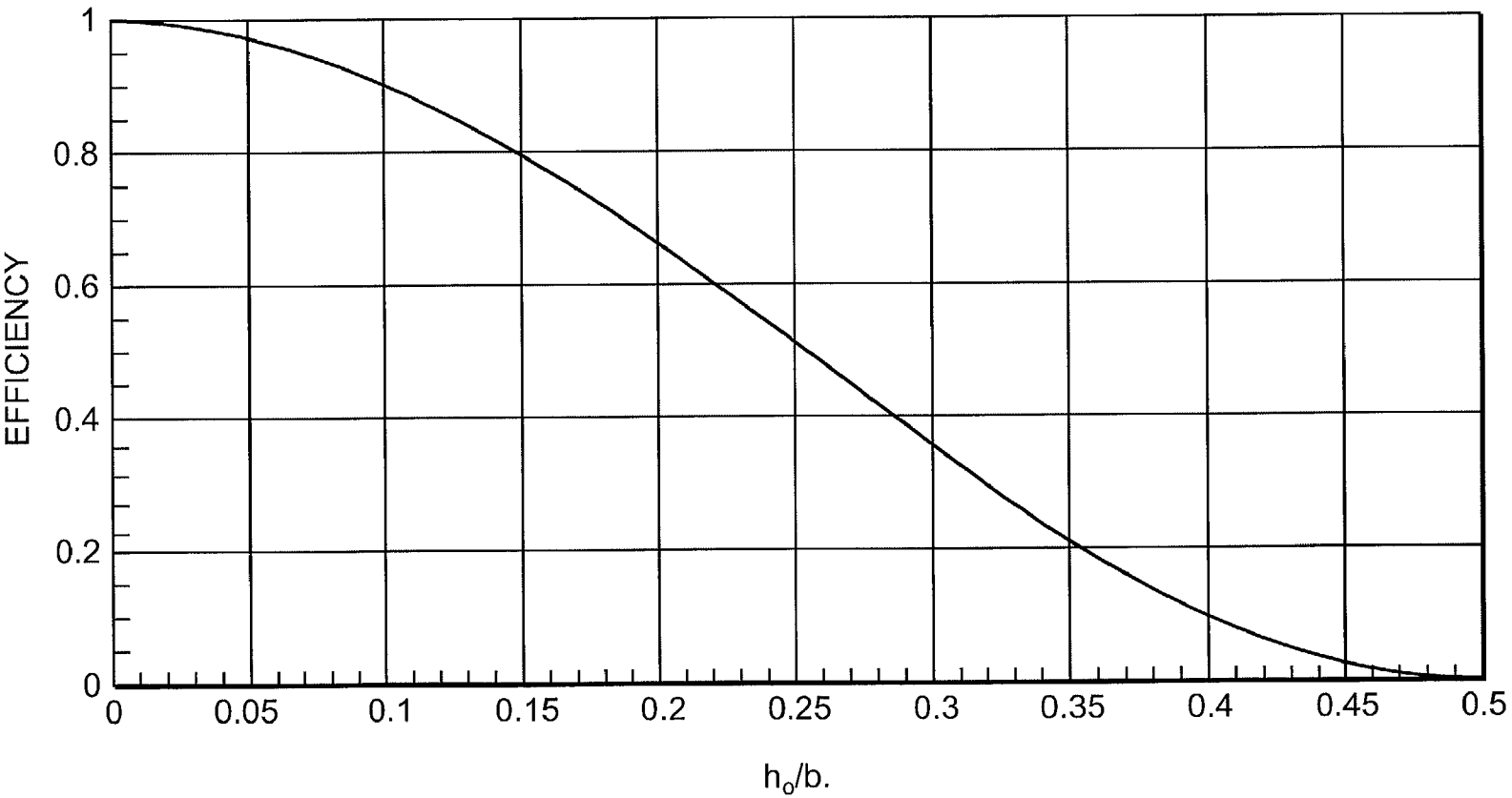
FIG. 15 plots efficiency at an ideal length as a function of initial height.

This relation, and an alternate one in terms of $\bar{h}(0)$ (via equation (31)), are shown in FIGS. 14 and 15.

While efficiency is important, so, too, is drying rate (per unit area). With a view toward use of multi-pass (serpentine) applicator units, the machine-direction (MD) length (per pass) can be (arbitrarily) defined as ($\alpha/f_{WG}$), which includes both the open (non-waveguide) area between passes and the waveguide MD width. A reference drying rate, based on the absorption length and on the approximation that all energy absorbed produces evaporation, can then be defined as:

$$\dot{m}''_{D,Ref} \equiv f_{WG}P_{in}/(\lambda(\lambda_0) \tag{34}$$

The actual (dimensionless) drying rate for an ideal-length waveguide can be shown to be:

$$\bar{\dot{m}}''_D \equiv \dot{m}''_D/\dot{m}''_{D,Ref} = \left(\frac{2}{1+2\bar{L}}\right) = 2(1-\eta) \tag{35}$$

Figure 16:
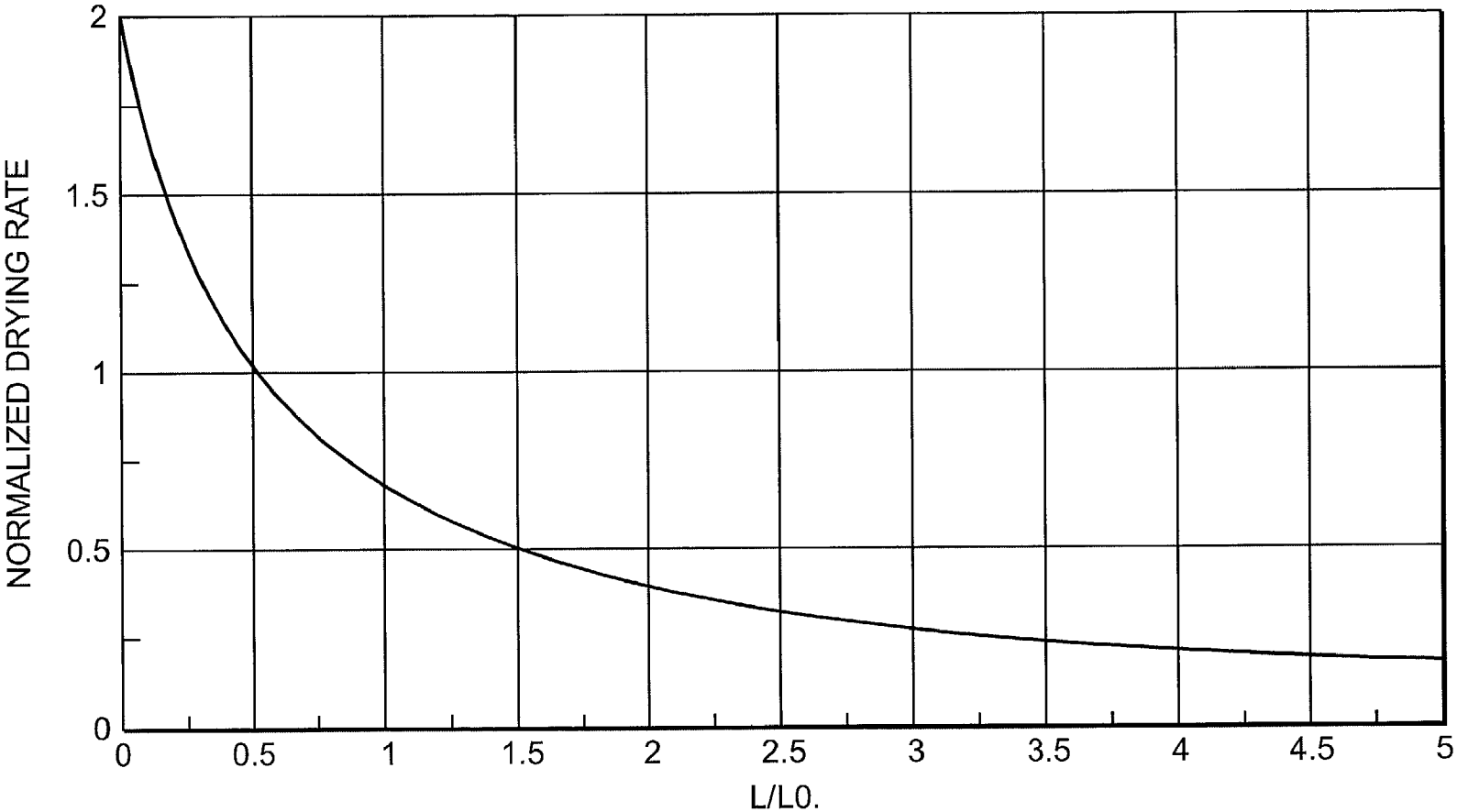
FIG. 16 illustrates the normalized drying rate for an ideal slot length.
Figure 18:
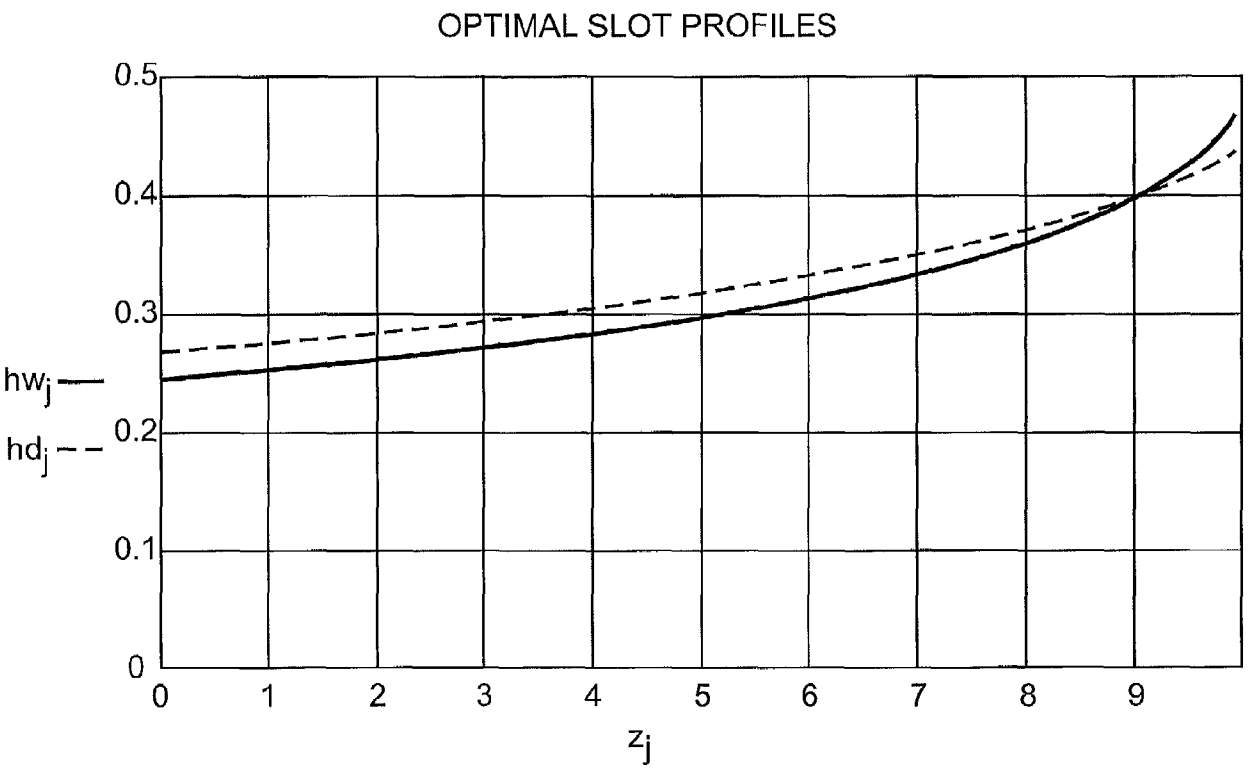
FIG. 18 illustrates optimal slot height dividied by the waveguide height as a function of distance from the microwave source.

This relationship is shown in FIG. 14. Considering FIGS. 15 and 16 together, there is a tradeoff between efficiency (operating cost) and drying intensity (space and capital cost).

Extension of Ideal Slot Results to Serpentine (Multi-Pass) Applicators

For paper manufacture applications, the ranges of basis weight and moisture content of interest, together with the selected frequency (0.915 GHz or 2.45 GHz), will correspond to a wide range of $L_0$ values. In combination with the range of typical paper machine widths ($L_{PM}$), a wide range of $\bar{L}_{ideal}$ is, thus, to be expected. From the results presented, it can be seen that there are some paper manufacture applications for which a single-pass applicator would have an unacceptably low efficiency. In this situation, additional passes to absorb energy not absorbed in the first pass, would be indicated.

Two alternative multi-pass system design strategies can be considered. One strategy (#1) would be to select the same "initial slot height" for each pass, ending the slot at the mid-plane for each pass. The other (#2) would be to consider the total active length of the multi-pass system to be equivalent to one longer pass, with the slot shape varying continuously over the entire unit (reaching the mid-plane only at the end of the final pass). For these strategies, the initial slot height for (#1) would clearly have to exceed that for (#2), assuming $L_0$ is constant. It appears that strategy (#1) will always yield higher efficiency than strategy (#2), for a given number of passes.

For strategy (#1), with N passes, the following results are easily derived:

$$\eta_{overall} = 1-(1-\eta_{1\text{-}pass})^N \tag{36}$$

and, (using equation 35 to get the second form):

$$\overline{m}''_{D,overall} = \overline{m}''_{D,1\text{-}pass}\left[\frac{\sum_{i=1}^{N}(1-\eta_{1\text{-}pass})^{i-1}}{N}\right] = 2\left[\frac{\sum_{i=1}^{N}(1-\eta_{1\text{-}pass})^{i}}{N}\right] \quad (37)$$

Thus, the efficiency of a multi-pass system increases, but the average drying rate decreases, compared to those for a 1-pass system.

In applying the above results, parameters are specified for the waveguide (frequency, dimensions, and impedance), the moist paper (dielectric loss coefficient), and the paper machine (cross-direction length and water loadings). Approximate values for water are utilized, together with data for moist paper at another frequency, to make a preliminary estimate (via a procedure outlined below) of the required loss coefficients. The waveguide parameters and water loss coefficient values are given in Table 1. The wide ranges of water loadings (the product of paper basis weight and moisture ratio) and cross-direction lengths (LPM) of potential interest for the paper industry (encompassing applications from web heating through the drying process) are given in Table 2.

TABLE 1

Waveguide and Water Loss Coefficient Parameters.

| f(GHz) frequency | fc(GHz) [cutoff frequency] | Z(ohm) | a(m) | b(m) | $\epsilon_r''$, water at 25° C. | $\epsilon_r''$, water at 50° C. |
|---|---|---|---|---|---|---|
| 0.915 | 0.605 | 503 | 0.124 | 0.2477 | 3.5 | 1.8 |
| 2.45 | 2.078 | 712 | 0.034 | 0.0721 | 9 | 5 |

TABLE 2

Typical Paper Manufacture Parameter Ranges.

| | BW, g/m$^2$ | $m_r$, kgwater/kgsolid | $m_w''$, g/m$^2$ | $L_{PM}$, m |
|---|---|---|---|---|
| I. Min (approx.) | 15 | 0.1 | 15 | 1 (pilot PM) |
| Max (approx.) | 300 | 2 | 600 | 10 |

The analysis in the preceding section has shown that it is actually the product $\epsilon''_r t$ that is important in characterizing applicator performance. The available data on loss coefficient for moist paper indicate that, above moisture contents of about 12%, the loss coefficient is approximately directly proportional to the apparent density of water in the structure (i.e., the mass of water per unit volume of paper). Therefore, multiplying both the loss coefficient and the apparent water density by the thickness (t) we see that $\epsilon''_r t$ is a function of water loading (mw", g/m2), for a given frequency and temperature. The cited data also indicate that, at water apparent densities approaching unity, the loss coefficient is only about half that for pure water. Extrapolating the above observations to the case of other frequencies and temperatures, an approximate relationship for $\epsilon''_r t$ is found:

$$\epsilon''_r t \approx 0.5\times10^{-6}\epsilon''_{r,water} m''_w \quad (38)$$

if t is in meters and $m''_w$ in g/m2.

With the approximate relationship described by equation 38, data from Tables 1 and 2 can be employed to calculate the values of the absorption length for frequencies and water loadings of interest. The results of such calculations are given in Table 3.

There are some soft constraints on the range of waveguide designs that are of practical interest. First, there must be a lower bound on the initial height ratio, h(0)/b, because it would be difficult to ensure that the paper could travel very close to the bottom wall of the waveguide. A suggested lower bound for this ratio would be about 0.1. According to equation 31, this would constrain the ideal dimensionless length to $\Gamma_{ideal} \leqq 4.74$.

A second constraint would be related to the desire that the single-pass efficiency not be too low, because otherwise the number of passes need to get good overall efficiency would become large (see equation 37), causing the average drying rate to become small (see equation 38). For example, if the number of passes were limited to five, a single-pass efficiency of at least about 30% would be needed to achieve an overall efficiency above 80%. Using a single-pass efficiency of 30% as a suggested bound, the corresponding bound on ideal dimensionless length would be (approximately): $\Gamma_{ideal} \geqq 0.21$.

TABLE 3

Estimated Absorption Length (L0) Values.

| f (GHz) | $m_w''$ (g/m$^2$) | Temperature (° C.) | $\epsilon_r''t$ (m) | L0 (m) |
|---|---|---|---|---|
| 0.915 | 1.5 | 25 | 0.000002625 | 3687.09 |
| 0.915 | 30 | 25 | 0.0000525 | 184.35 |
| 0.915 | 600 | 25 | 0.00105 | 9.21 |
| 0.915 | 1.5 | 50 | 0.00000135 | 7169.36 |
| 0.915 | 30 | 50 | 0.000027 | 358.46 |
| 0.915 | 600 | 50 | 0.00054 | 17.92 |
| 2.45 | 1.5 | 25 | 0.00000675 | 110.11 |
| 2.45 | 30 | 25 | 0.000135 | 5.50 |
| 2.45 | 600 | 25 | 0.0027 | 0.27 |
| 2.45 | 1.5 | 50 | 0.00000375 | 198.21 |
| 2.45 | 30 | 25 | 0.000075 | 9.91 |
| 2.45 | 600 | 50 | 0.0015 | 0.49 |

If an example paper machine width of 5 m is considered, the definition of dimensionless length (equation 25) with the upper and lower bounds just identified can be combined, to establish a corresponding range of absorption length values: 1.06 m$\geqq L_0 \geqq$23.7 m. This range should correspond to the most promising papermaking applications for the technology under consideration. The water loading range and frequency combinations that correspond to this absorption length range are suggested by the results in Table 3. It appears that the use of 0.915 GHz is best suited for the mid-to-upper portion of the loading range, while the 2.45 GHz frequency may be advantageous for lower water loading situations.

The use of a variable waveguide applicator slot height has been shown to provide a way to achieve uniform heating of wide webs. Based on the calculations using estimated loss coefficients, it appears that at least a significant portion of the spectrum of meaningful paper machine width and water loading combinations should be suited to the application of the technology investigated here.

We claim:

1. A microwave waveguide comprising:

broad walls separated by and electromagnetically coupled with at least one field modifier, wherein said modifier has a nonlinear profile, and wherein said field modifier is configured to provide a relative slot height profile as defined by $$h(z)=(b/\pi)\sin^{-1}[(1/\sin^2(\pi h_o/b)-2\omega Z\epsilon_o\epsilon''_r tz/b)^{-1/2}].$$

2. The microwave waveguide according to claim 1, wherein said field modifier is adjustable.

3. The microwave waveguide according to claim 2, wherein said field modifier is adjusted through the use of mechanical actuators.

4. The microwave waveguide according to claim 2, wherein said field modifier is adjusted in response to a sensed condition in a web to be dried.

5. The microwave waveguide according to claim 1, wherein said waveguide includes at least two field modifiers having nonlinear profiles.

6. The microwave waveguide according to claim 1, wherein said field modifier is physically coupled to said broad walls.

7. The microwave waveguide according to claim 1, wherein said field modifier is capacitively coupled to said broad walls.

8. The microwave waveguide according to claim 1, wherein said field modifier is configured to provide uniform heating or drying along the length of the waveguide.

9. The microwave waveguide according to claim 1, wherein the broad walls comprise a slot at least partially off-center.

10. A microwave waveguide comprising:

broad walls separated by and electromagnetically coupled with at least one narrow wall, wherein said narrow wall has a nonlinear profile, and wherein said narrow wall is configured to provide a relative slot height profile as defined by $$h(z)=(b/\pi)\sin^{-1}[(1/\sin^2(\pi h_o/b)-2\omega Z\epsilon_o\epsilon''_r tz/b)^{-1/2}].$$

11. The microwave waveguide according to claim 10, wherein said narrow wall is adjustable.

12. The microwave waveguide according to claim 10, wherein said waveguide includes at least two narrow walls having nonlinear profiles.

* * * * *